US005867403A

United States Patent [19]

Sasnett, Jr. et al.

[11] Patent Number: 5,867,403

[45] **Date of Patent: *Feb. 2, 1999**

[54] FUEL DISPENSER

[75] Inventors: Bolling H. Sasnett, Jr.; Bolling H. Sasnett, III, both of Atlanta; Richard M. Huff, Decatur; Bruce A. Works; Randall C. Watts, both of Atlanta, all of Ga.

[73] Assignee: Universal Epsco, Inc., Atlanta, Ga

[ * ] Notice: This patent issued on a continued prosecution application filed under 37 CFR 1.53(d), and is subject to the twenty year patent term provisions of 35 U.S.C. 154(a)(2). .

[21] Appl. No.: 540,720

[22] Filed: Oct. 11, 1995

[51] Int. Cl.[6] ..... B67D 5/08; B67D 5/10

[52] U.S. Cl. ..... 364/528.17; 364/479.01; 364/479.02; 364/479.03; 364/479.06; 364/479.08; 364/479.09; 364/709.15; 222/1; 222/14; 222/23; 222/26; 222/27; 137/2; 141/2; 141/192; 141/206; 141/210

[58] Field of Search ..... 364/237.2, 237.5, 364/927.2, 927.5–927.7, 927.63–927.64, 465, 528.16–528.17, 479.01–479.03, 479.06, 479.08–479.09, 709.15; 222/1, 14, 22, 23, 26, 27, 36, 132–135, 144.5, 145.1; 53/467–468; 141/2, 11, 192, 206, 210, 328; 705/413

[56] References Cited

U.S. PATENT DOCUMENTS

| | | | |
|---|---|---|---|
| 4,280,121 | 7/1981 | Crask | 340/365 |
| 4,410,949 | 10/1983 | Huellinghorst et al. | 364/465 |
| 4,461,401 | 7/1984 | Sasnett, Jr. | 222/27 |
| 4,503,994 | 3/1985 | Pyle | 222/64 |
| 4,576,312 | 3/1986 | Swick, Jr. | 222/27 |
| 4,627,553 | 12/1986 | Yoshida et al. | 222/14 |
| 4,634,225 | 1/1987 | Haim et al. | 350/331 |
| 4,750,130 | 6/1988 | Shimamura et al. | 364/465 |
| 4,931,969 | 6/1990 | Hirami et al. | 364/709.15 |
| 4,978,029 | 12/1990 | Furrow et al. | 222/1 |
| 5,249,129 | 9/1993 | Lamoureux et al. | 364/479 |
| 5,270,843 | 12/1993 | Warn | 364/479 |
| 5,394,336 | 2/1995 | Warn et al. | 364/479 |
| 5,489,918 | 2/1996 | Mosier | 345/89 |
| 5,517,212 | 5/1996 | Inoue | 345/211 |

OTHER PUBLICATIONS

Universal Epsco, Inc., "Univision™ Series Dispenser," Sales Information, 2 pages.

Sharp Corporation, Device Specification for Passive Matrix LCD Unit Model No. LM64K83, 7 pages.

*Primary Examiner*—Emanuel Todd Voeltz
*Assistant Examiner*—Tuan Q. Dam
*Attorney, Agent, or Firm*—Isaf, Vaughan & Kerr

[57] ABSTRACT

A fuel dispenser is disclosed. The fuel dispenser has a housing which contains two chambers, one contains a computer and the other the hydraulic parts of the dispenser. Fiber optic cables connect a fiber optic switch which detects the cradling of a nozzle to a computer, and other fiber optic cables connected to a pulser signal the flow of fuel in the meter of the dispenser to the computer. The computer controls a liquid crystal display which prompts the customer to actuate keys on a keyboard adjacent to the display. A pivotal boot supported by a horizontal shaft receives the nozzle. This boot pivots to permit better access to the hydraulic area of the housing. The shaft, itself, is rotatable to actuate a switch to indicate, through fiber optic cable, to the computer that the nozzle is stored and to shut down pumping. A fiber optic pulser feeds light signals to the computer for indicating the flow of fuel through the meter. A temperature probe adjacent to the display signals the temperature of the display to the computer so that the computer automatically controls the voltage bias, and thus the contrast, of the liquid crystal display. The computer provides selective screens which enables the parameters of operation of the dispenser to be changed and supplies diagnostic data on screens for repairs.

10 Claims, 25 Drawing Sheets

HEATER/FAN CONTROL ALGORITHM

Tda=DISPLAY TEMP PROBE, SIDE 'A'
Tdb=DISPLAY TEMP PROBE, SIDE 'B'

FANS

IF Tda OR Tdb<20 DEG F, TURN FANS OFF
IF Tda OR Tdb>130 DEGF, TURN FANS ON
IF Tda AND Tdb>70 DEG F, TURN FANS ON

HEATERS

IF TdA OR Tdb<35 DEG F, TURN HEATERS ON
IF Tda AND Tdb>50 DEG F, TURN HEATERS OFF

*FIG. 15*

SIDE 2
OPERATOR KEYPAD
SIDE 2
DISPLAY ASS'Y
LIQUID CRYSTAL
DISPLAY
BACK
LIGHT
J5
10-20A
PIA
BOARD
FAN
J4
TEMP
SENSOR
J2
J3
J1
HEATER STRIP
J1
J2
J5
J11
MATCH LINE TO FIG. 18B
22 GA. BLK
22 GA. WHT/RED
AMBIENT
TEMP.
PROBE
OPTICAL RELAYS-
SUCTION PUMPS ONLY
S.S.R.
#1
S.S.R.
#2
S.S.R.
#3
S.S.R.
#4
22 GA. RED
22 GA. BLK
22 GA. BLK
22 GA. BLK
22 GA. BLK
J1
+
1
2
3
4
J3
J2
POWER
TRANS-
FORMER
VALVE
POWER
VALVE
POLARITY
J4
H N G
J19
S N H
MATCH LINE TO FIG. 18E

SIDE 1
OPERATOR KEYPAD
LIQUID CRYSTAL
DISPLAY
J22
OPTION
CARD
BUS
J18
RS 232
P.C. PORT
J10
ATC TEMP.
PROBE PORT
J21
INT. KEYPAD
(NOT USED)
SIDE 1 FIBER OPTIC TERM
J19
J20
J16
J17
HOSE 3 HOSE 2 HOSE 1
P1
P2
NS
YEL
ORG
RED
10-20A
PIA
BAORD
J5
J4
J1
J3
J2
MATCH LINE TO FIG. 18B
MATCH LINE TO FIG. 18D
DISPENSER HEAD
(CLASS I, DIV. 2)
DISPENSER CABINET
(CLASS I, DIV. 1)

SIDE 1 NOZZLE SWITCHES
J13
S L N
BLU
FIBER
OPTIC
CABLE
MATCH LINE TO FIG. 18G

FUEL DISPENSER

FIELD OF INVENTION

This invention relates to a fuel dispenser and is more particularly concerned with a dispenser for pumping combustible fuels, such as a service station fuel dispenser.

BACKGROUND OF THE INVENTION

In the past, quite a number of fuel dispensers or pumps have been produced which incorporate, thereon, electrical controls in combination with computers which provide signals both to the dispenser and to a display on the dispenser for indicating various parameters relating to credit card acceptance, price, delivery of fuel to a purchaser and automatically records of the transactions. Such an operation requires electricity, supplied via various cables and wires to various parts of the dispenser including the hydraulic portion of the dispenser. Thus, there is always a danger of fumes and fuel being ignited by an electrical spark. Therefore, special precautions must be taken to reduce the likelihood of generating sparks in the hydraulic area.

Many prior art fuel dispensers have switches, which must be actuated by a customer. These switches are in various places on the housing, including switches for the selecting which grade of fuel to deliver and which nozzle is to be used so that the customer must, locate the appropriate switch and remove the appropriate nozzle for the selected grade of fuel to be delivered.

Servicing of the various components of the prior art dispensers has been difficult, due to the inaccessibility of these components. The servicing, itself, of electrical components of the dispenser may result in sparks being generated so as to ignite gas fumes which have accumulated in the hydraulic area. Thus, strict regulations have been devised for fuel dispensers requiring, in "Class 1, Division I areas" explosive proof conduits and intrinsically safe barriers.

Another problem with fuel pumps which use electric displays is that, if fuel crystal displays are used, the temperature will affect the readability of the display. Thus, when heated, some fuel crystal displays become difficult to read.

SUMMARY OF THE INVENTION

Briefly described, the present invention, which seeks to overcome the difficulties described above, includes a fuel dispenser which is particularly adapted as a fuel pump, to dispense flammable fluids, such as various grades of fuel, from a single or multiple nozzles while providing for full graphic sales display in combination with a soft, full function, keypad in close proximity to the display and allowing a wide variety of features and configurations to be readily displayed and changed, by manipulation of the keyboard. The software enables the display, selectively, to provide advertising messages, information which prompts and instructs the customer step-by-step through the entire fueling operation and provides sales data, at the pump and to a remote location. Function keys are arranged around and adjacent to the display so that the display, itself, will direct the operator to the appropriate keys.

A temperature probe detects the temperature of the fuel crystal display and, through the computer, automatically controls and adjusts the voltage bias to the display so as to maintain a readable display, even though the display may have been heated by the ambient air and/or the sun. A fan directs air onto the face of the fuel crystal display in order to cool the fuel crystals.

In the housing is a pivotable nozzle boot which can be pivoted on a shaft to a prescribed position for permitting access to the interior of the Class 1, Division I, hydraulic area. Aligned fiber optic cables, in the hydraulic area, straddle this shaft, so that a hole, through the shaft, forms a fiber optic switch which indicates that the nozzle has been removed from the boot. A fiber optic pulser is also used in the Class 1, Division I hydraulic area, thereby eliminating many of the explosion proof cables, and the intrinsically safe barriers.

The dispenser is so constructed that the computer within the upper portion of the housing is readily accessed, since the transflective fuel crystal display and its blower are mounted on a frame which can be pivoted outwardly.

Accordingly, it is an object of the present invention to provide a fuel dispenser capable of pumping flammable fuels wherein the danger of the ignition of the flammable fuel or fumes is reduced.

Another object of the present invention is to provide a fuel dispenser having a fuel display thereon which is capable of selectively displaying advertising information, and/or instructions, prompting the customer to readily manipulate the dispenser for dispensing the selected grade of fuel in the selected quantity.

Another object of the present invention is to provide a fuel dispenser which permits a customer to easily access switches for selecting a variety of parameters under which the fuel will be dispensed.

Another object of the present invention is to provide a customer controlled fuel dispenser in which both the instructions for operating the dispenser and the means for actuating the dispenser are contained in a common, readily accessible area on the pump.

Another object of the present invention is to provide a display assembly for a fuel dispenser, wherein the function keys and the screens which cooperate with the keys can readily be changed.

Another object of the present invention is to provide a fuel crystal display in which the contrast between the characters and the background is automatically adjusted for variations in the temperature of the display.

Another object of the present invention is to provide a fuel dispenser in which the various areas of the dispenser can be readily accessed for repairs or replacement.

Another object of the present invention is to provide a dispenser which is inexpensive to manufacture, durable in structure and efficient in operation.

Other objects, features and advantages of the present invention will become apparent from the following description when considered with the accompanying drawings wherein like characters of reference designate corresponding parts throughout the several views.

BRIEF DESCRIPTION OF THE DRAWINGS

FIG. 15 is an illustration of a heater/fan algorithm.

DETAILED DESCRIPTION AND SPECIFICATION OF THE INVENTION

Figure 1:
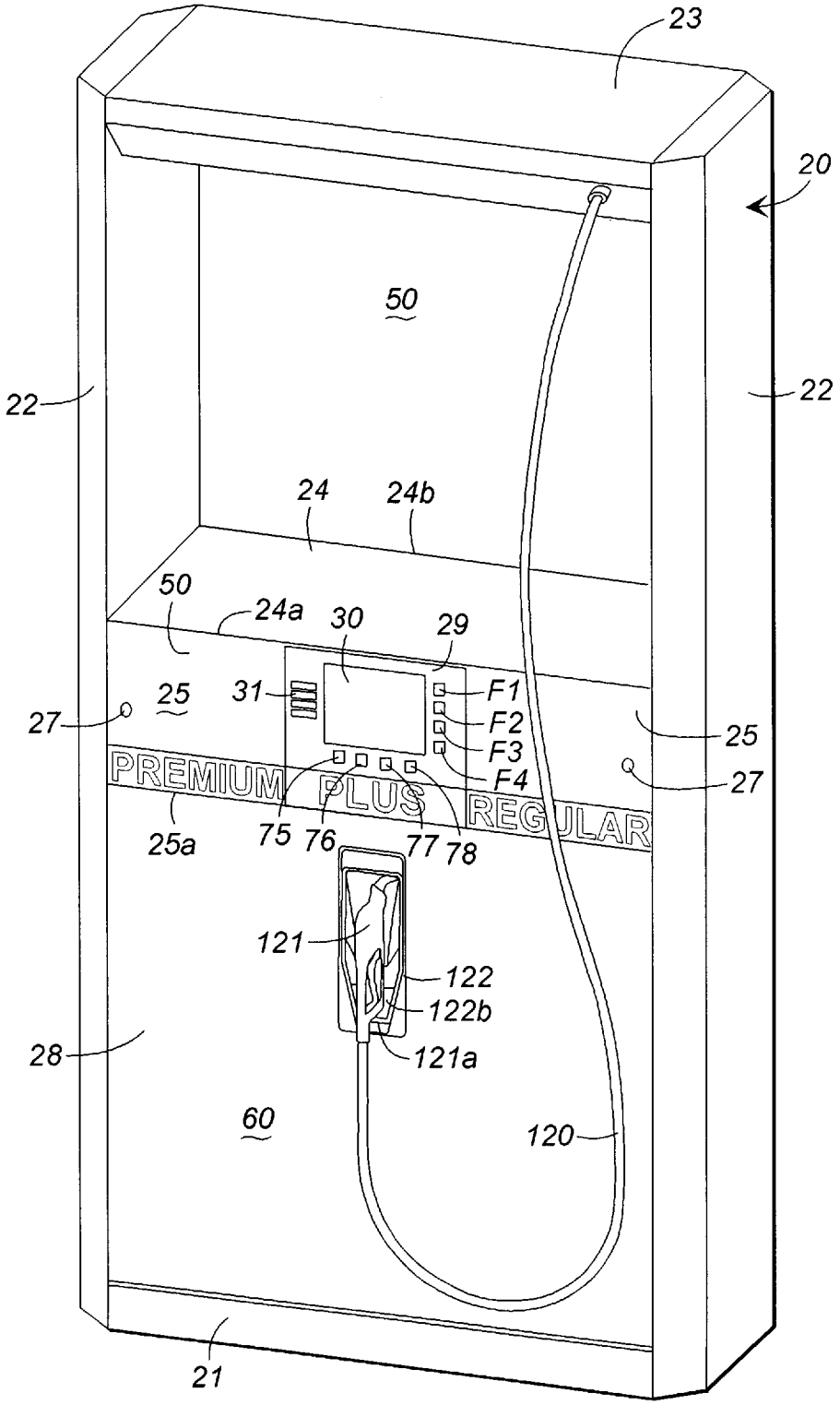
FIG. 1 is a perspective view of a fuel dispenser constructed in accordance with the present invention.

Referring now in detail to the embodiment herein chosen for purposes of illustrating the preferred embodiment of the present invention, numeral 20 denotes, generally, the housing of the fuel dispenser of the present invention. This dispenser is illustrated as a fuel pump or dispenser of the general type used in service stations. The dispenser has a base 21, a pair of opposed, upright, channel shaped, side panels 22 and a top panel 23, the top panel 23 extending between the upper end portions of side panels 22. The base 21 extends between the lower end portions of side panels 22. A head plate 24 extends horizontally across intermediate portions of panels 22. The housing is provided with an inner frame which supports much of the operating structure.

Extending downwardly from the opposed edges 24*a* and 24*b* of head plate 24 are a pair of opposed dispenser removable face plates, such as face plate 25, shown in FIG. 1. Each face plate 25 is secured in place against upright struts (not shown) by a pair of longitudinally spaced face locks 27. By unlocking the two face locks 27 of face plate 25 can be removed from the housing 20 to expose the Class 1, Division II head area or upper chamber 50.

Below the lower edge 25*a* of each face plate 25, are a pair of opposed flat removable dispenser doors 28 which define with opposed portions of panels 22, the hydraulic area or lower chamber 60.

The central portion of each panel 25 is provided with a rectangular, central opening over which is mounted a rectangular keyboard having a keyboard plate 29, with a central rectangularopening, closed by a transparent plastic display window 30*a*.

Arranged in vertical, spaced, alignment apertures on the right side of plate 29 adjacent to window 30*a*, are the vertical function keys F1, F2, F3 and F4, parallel to the side of window 30*a*. Arranged along the opposite sides of display window 39*a* and on display plate 29, is a numeric keypad 31. Arranged in horizontal spaced relationship, in apertures in the lower central portion of plate 29, below window 30*a* are the aligned, horizontal function keys F5, F6, F7 and F8, parallel to the lower edge of window 30*a*. The transfiective liquid crystal display 30 is behind the window 30*a*. The display 30 is a 6"×8" transflective positive contrast 640×480 dot matrix that operates at 5 volts DC and 19–21 milliamps with an integral cold cathode backlight tube that operates at 1200 volts AC RMS and 7 microamps. The function keys F1 through F8 are connected to the computer 55. The computer 55 is a gasoline dispenser computer designed and manufactured by Universel Epsco, Inc. The computer 55 runs its program on a V-25 processor with 375 kbytes of static RAM.

Figure 2:
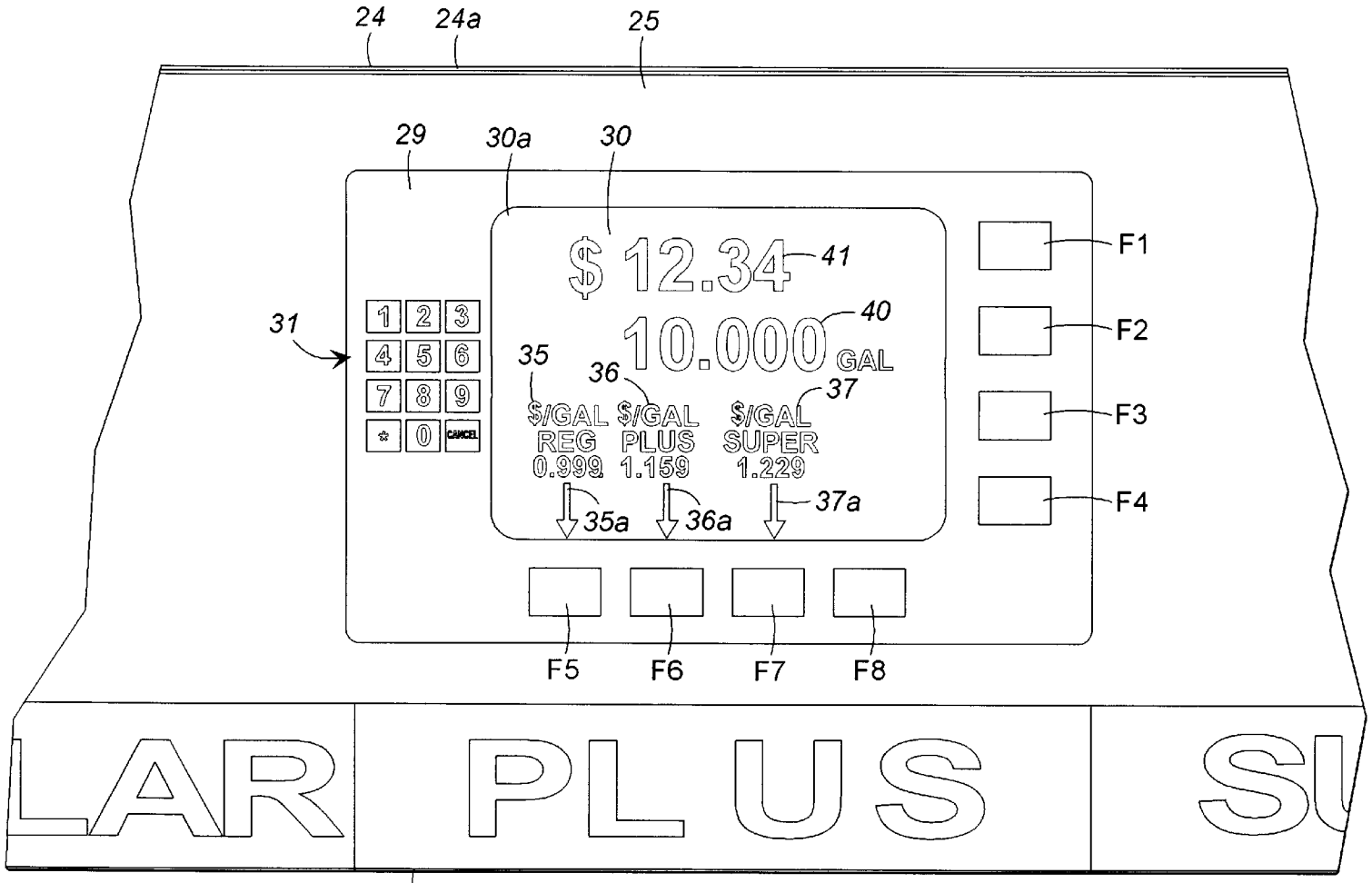
FIG. 2 is an enlarged front elevational view of a portion of the fuel dispenser shown in FIG. 1 and showing the keyboard and the fuel crystal display of the fuel dispenser illustrated in FIG. 1.

The customer or operator, when viewing a transfiective fuel crystal display 30 through window 30*a*, will be provided with one ore several successive screens of legends on the display 30 to prompt the customer as to which function keys that should be depressed. In FIG. 2, a typical screen, is shown which contains, at numeral 35, the cost per gallon (or liter) of fuel, such as "regular" fuel with an arrow 35*a* pointing to function key F5, at numeral 36; the cost per gallon for "plus" fuel with arrow 36*a* pointing to function key F6 and at numeral 37, the cost per gallon (or liter) of "super" fuel with an arrow 37*a* pointing to function key F7. The function key F8 is used if a fourth grade of fuel were offered or is used to call up a different screen.

In the area of the screen, above the legends 35, 36 and 37, displays, at numeral 40, the quantity of fuel delivered and at numeral 41 the total cost of that fuel.

Figure 14:
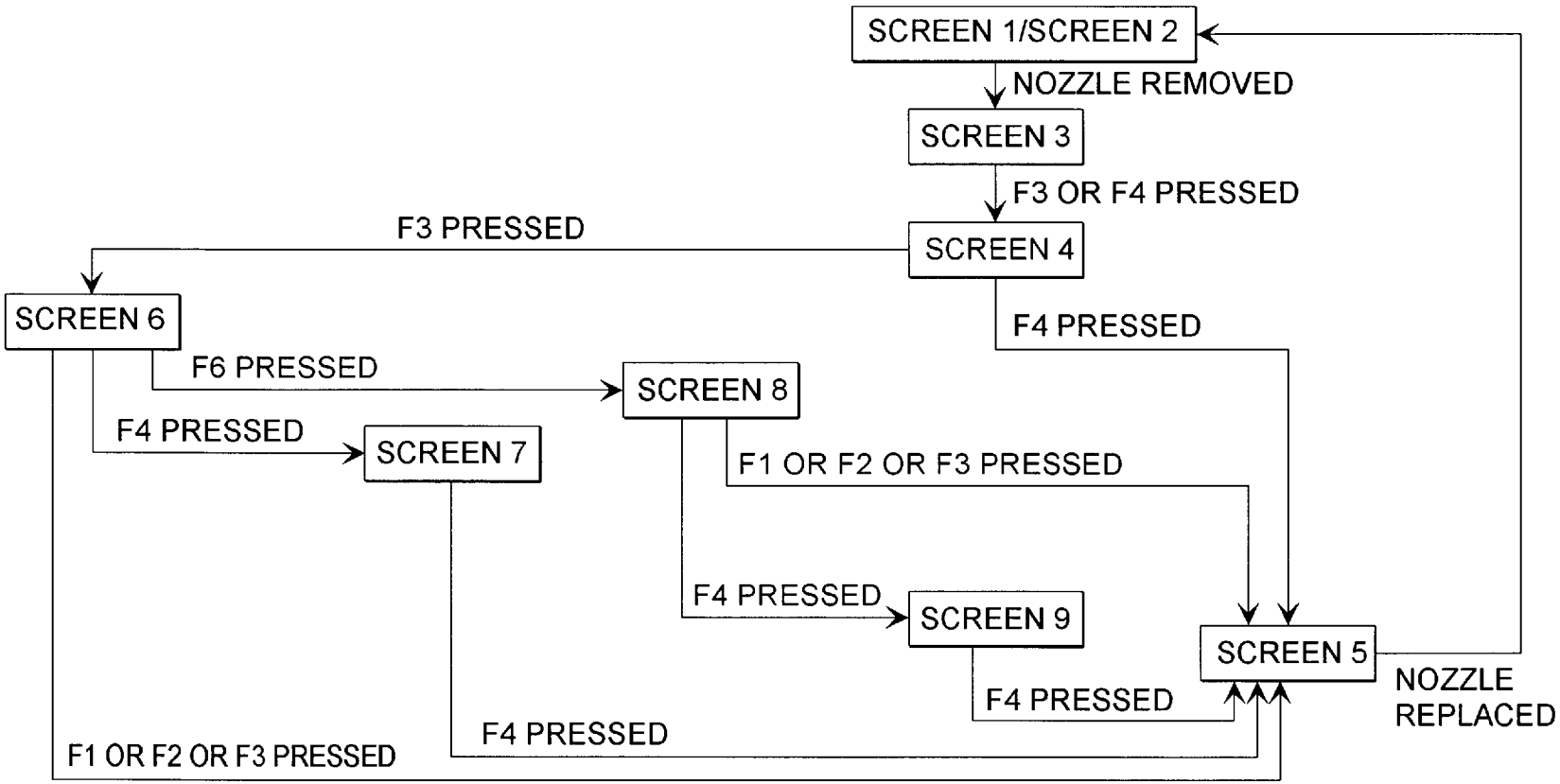
FIG. 14 is a logic flow chart for a display screen/function key.
Figure 16A:
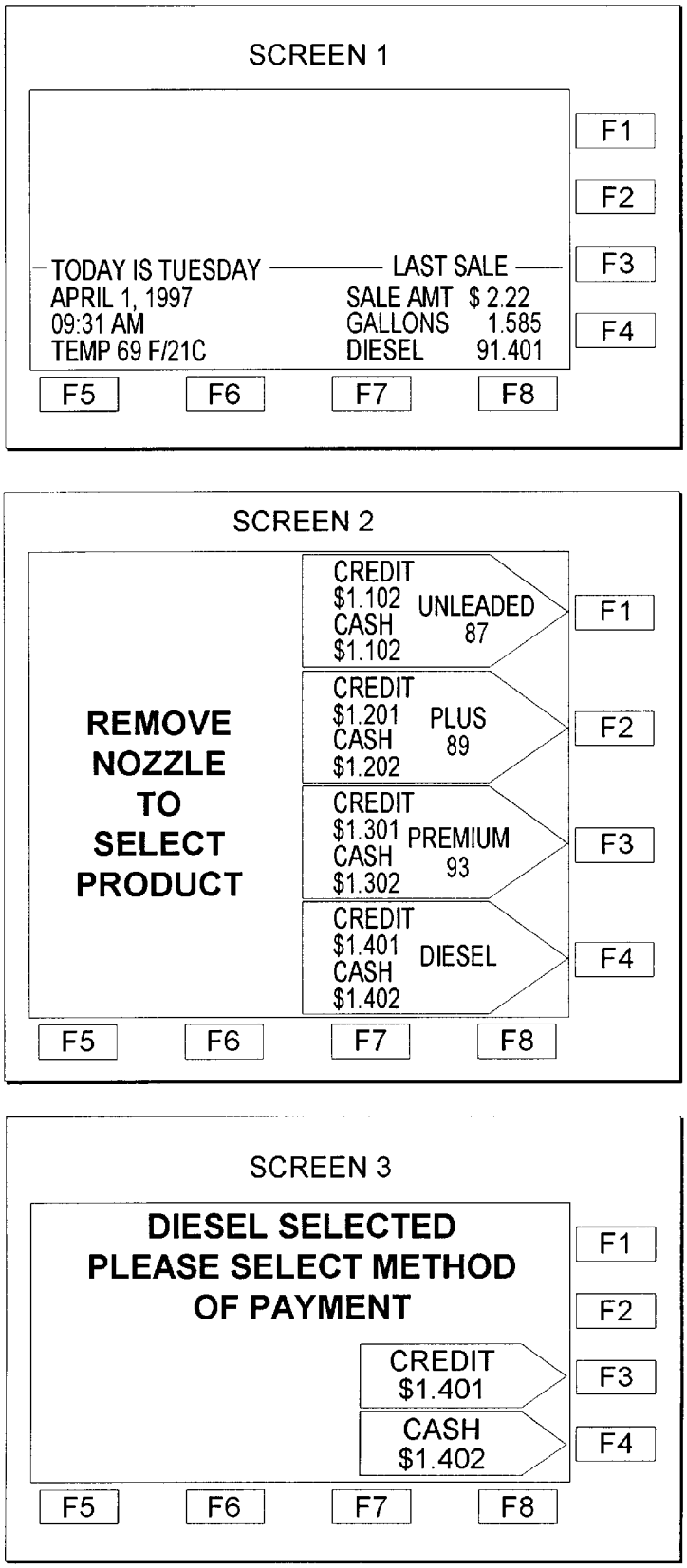
FIG. 16 is an illustration of a first example of the display screens/function key assignments.
Figure 16B:
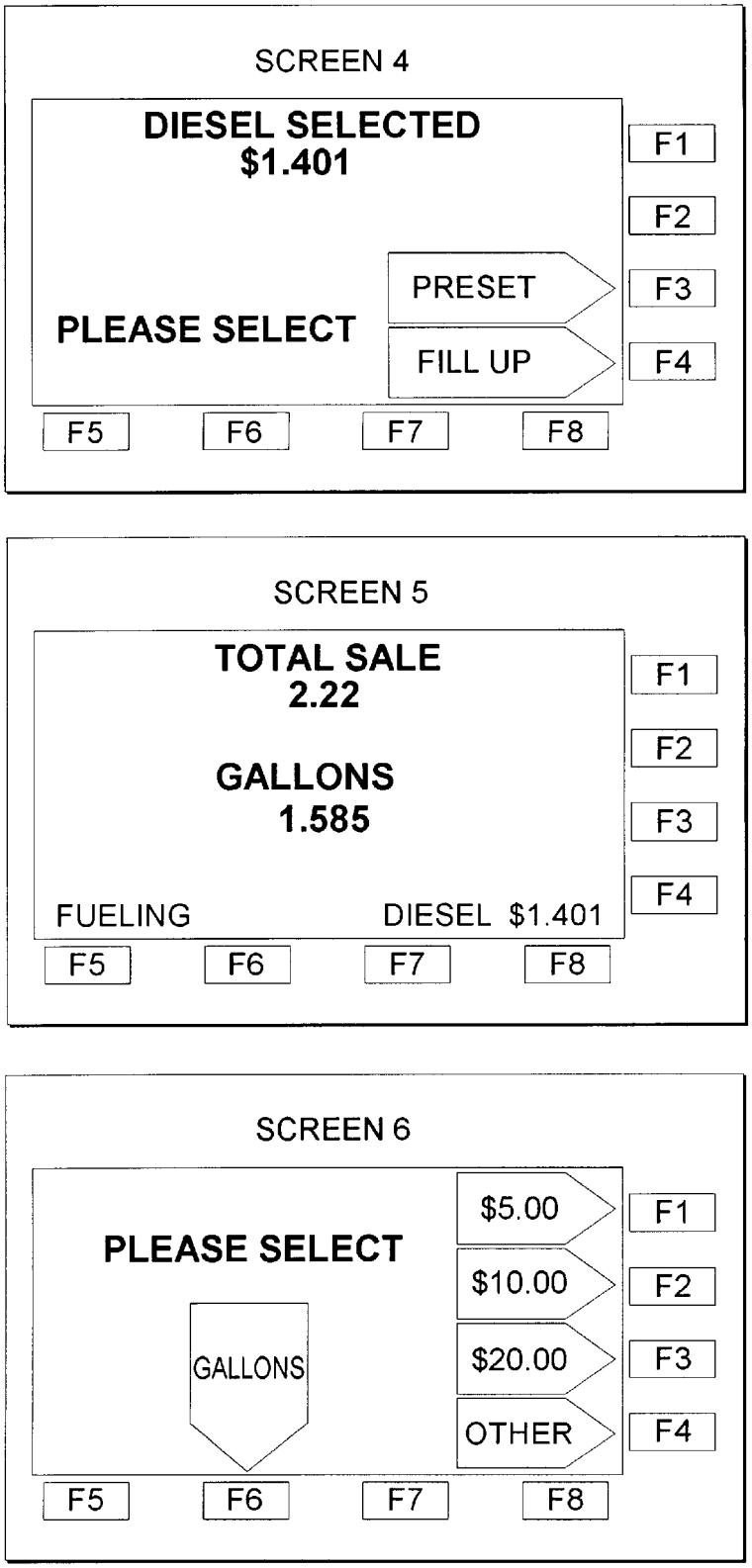
Figure 17:
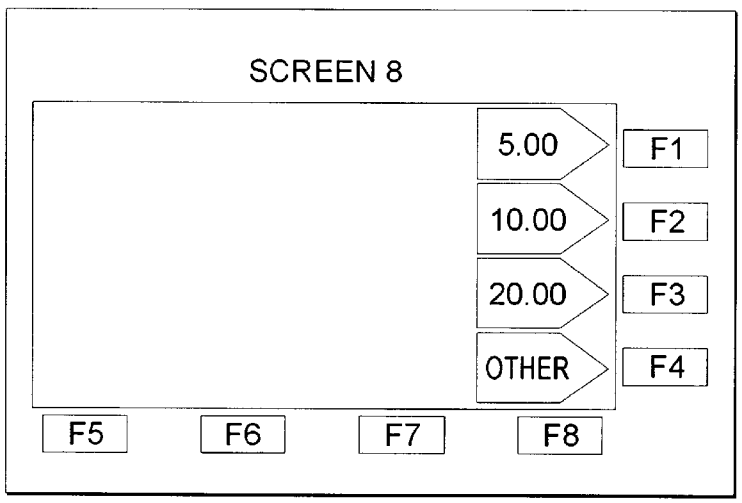
FIG. 17 is an illustration of a second example of the display screens/function key assignments.
Figure 17:
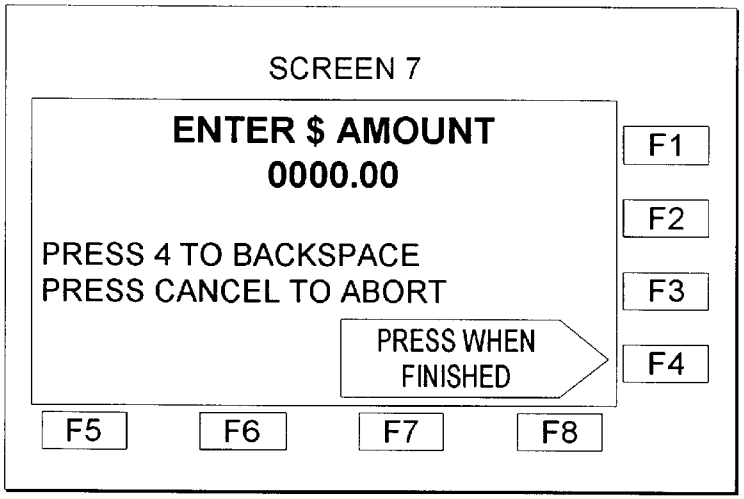
Figure 17:
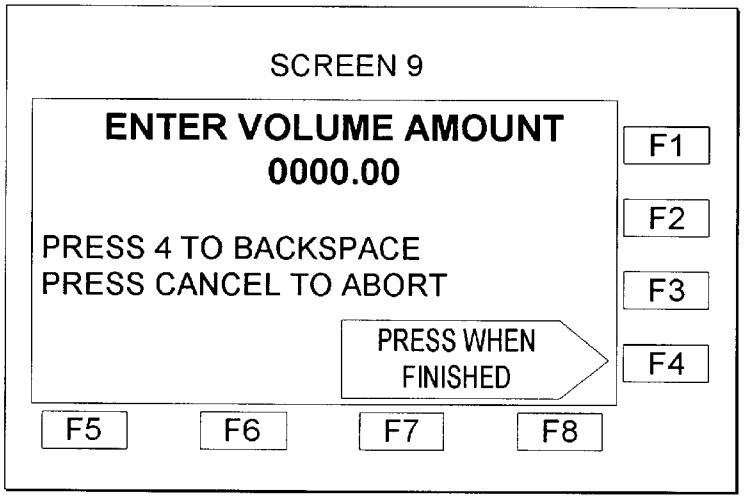
Figure 18A:
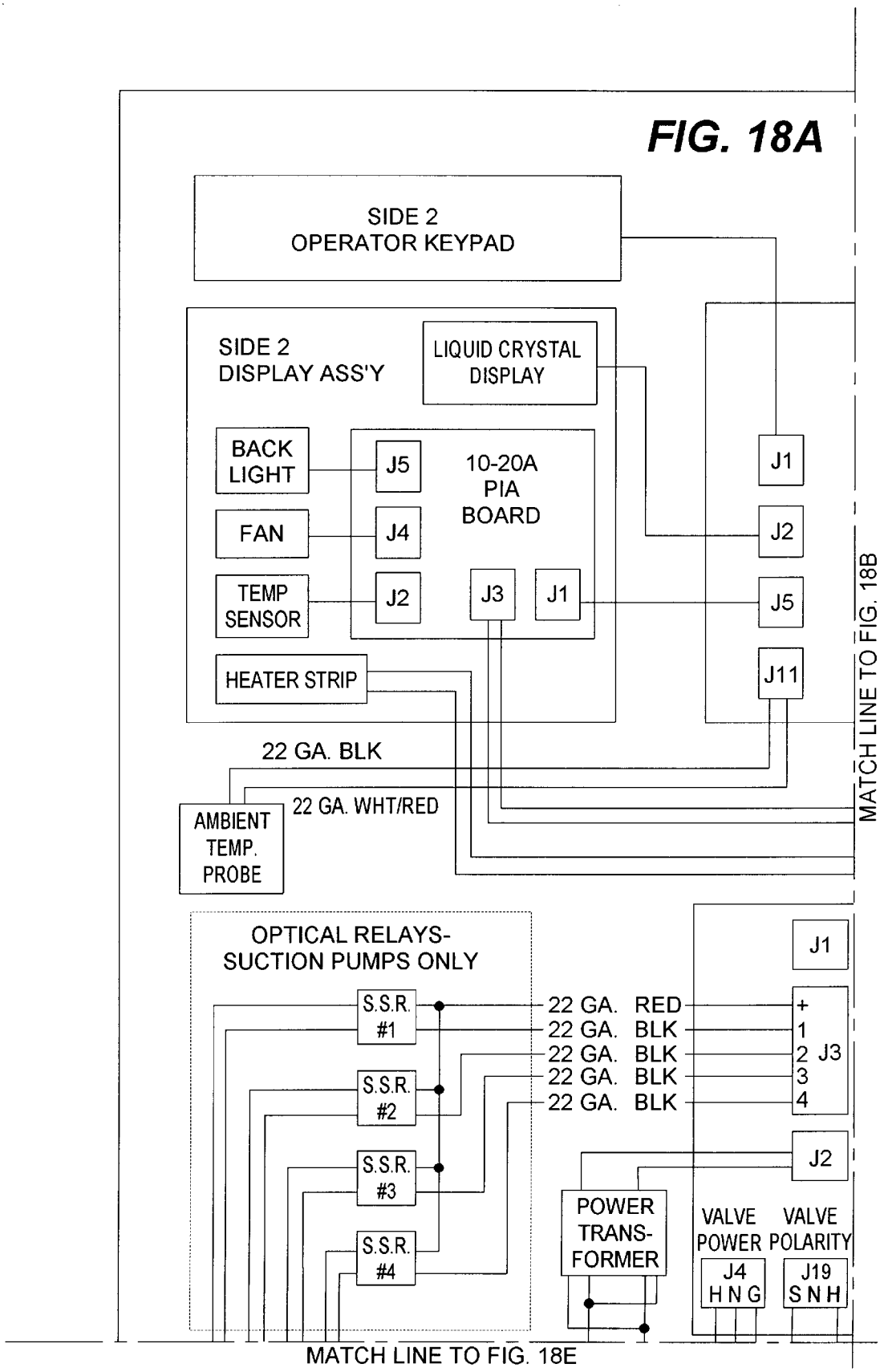
FIG. 18 is a schematic illustration of the system layout.
Figure 18B:
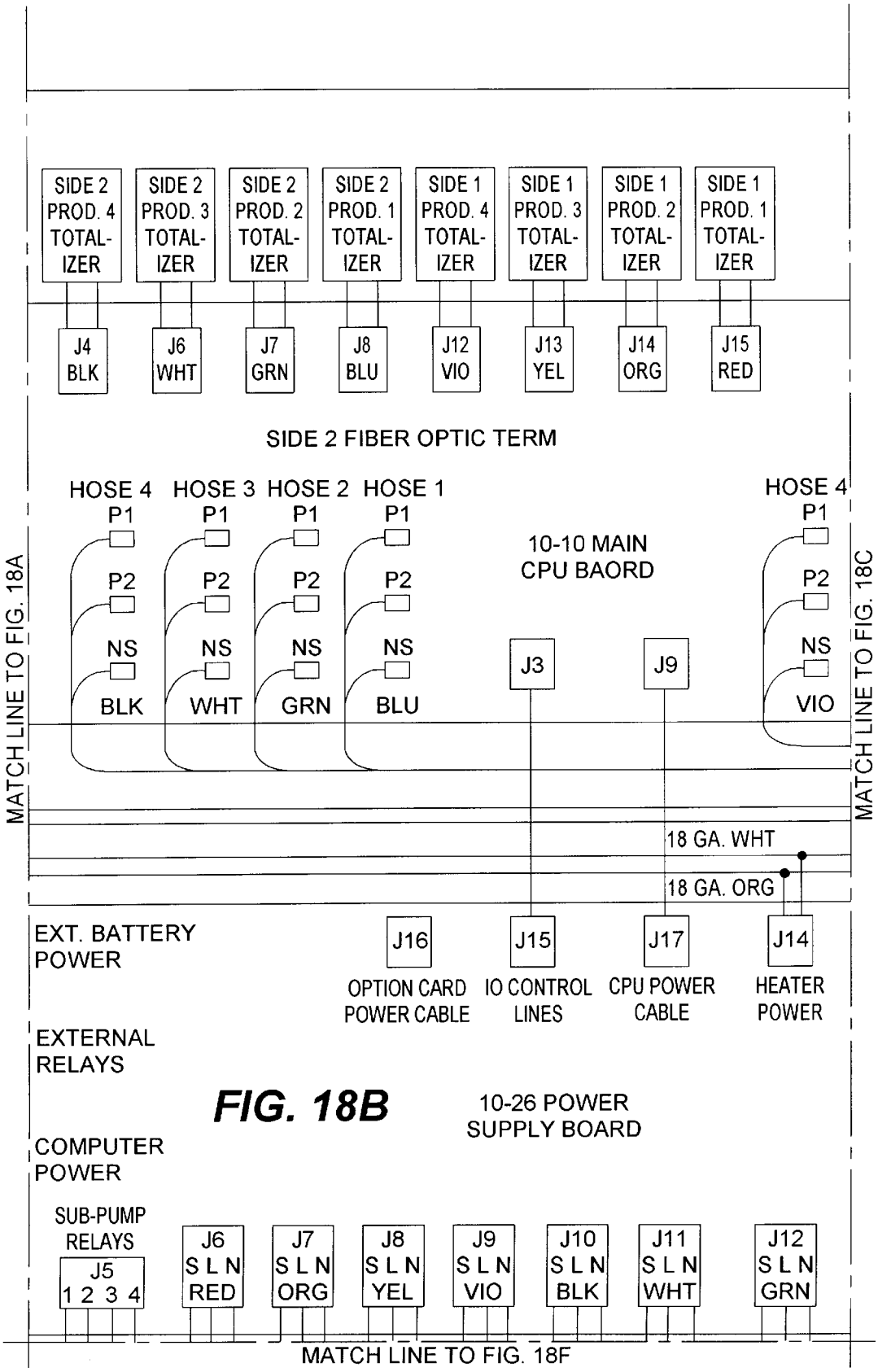
Figure 18C:
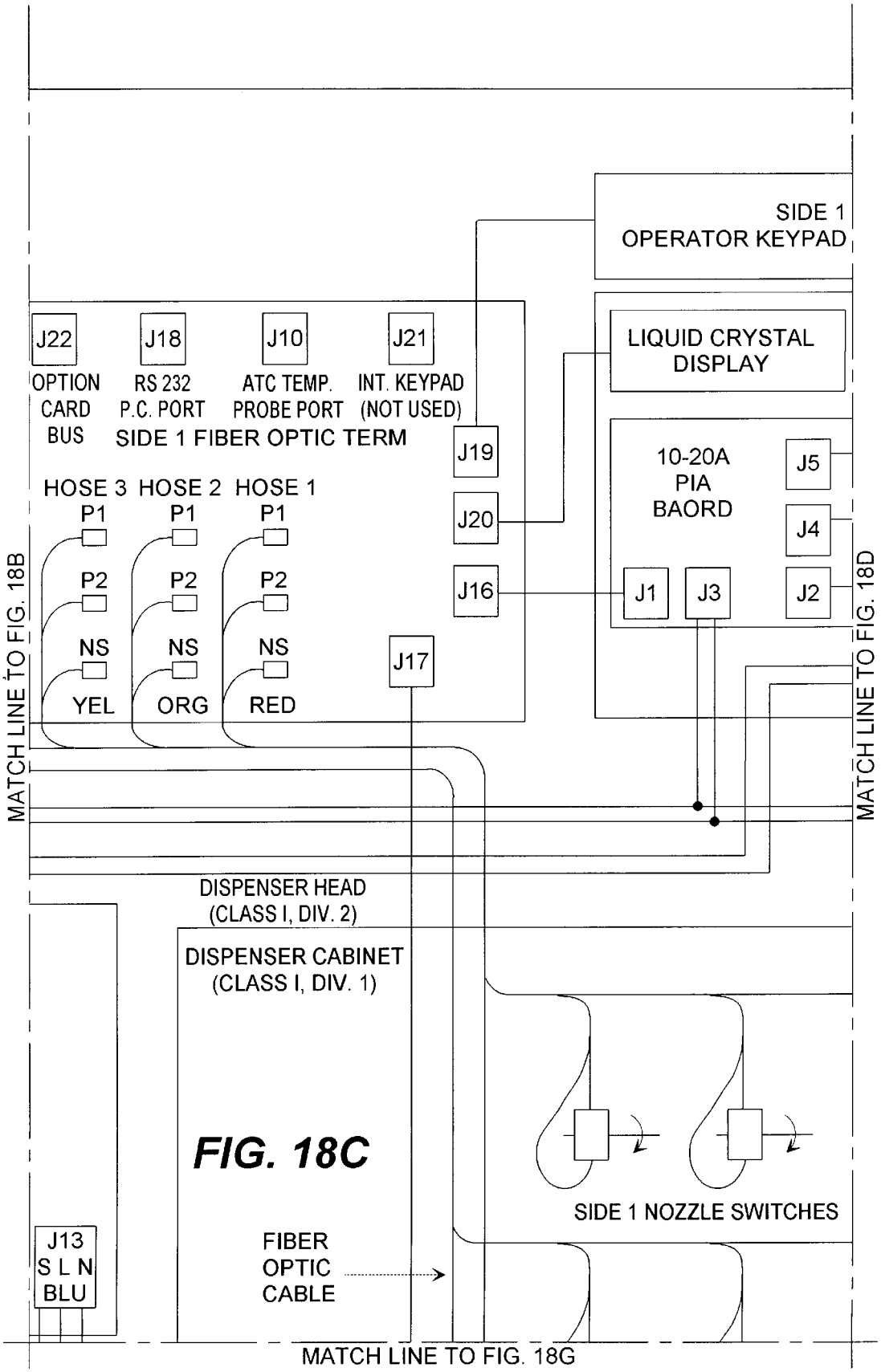
Figure 18D:
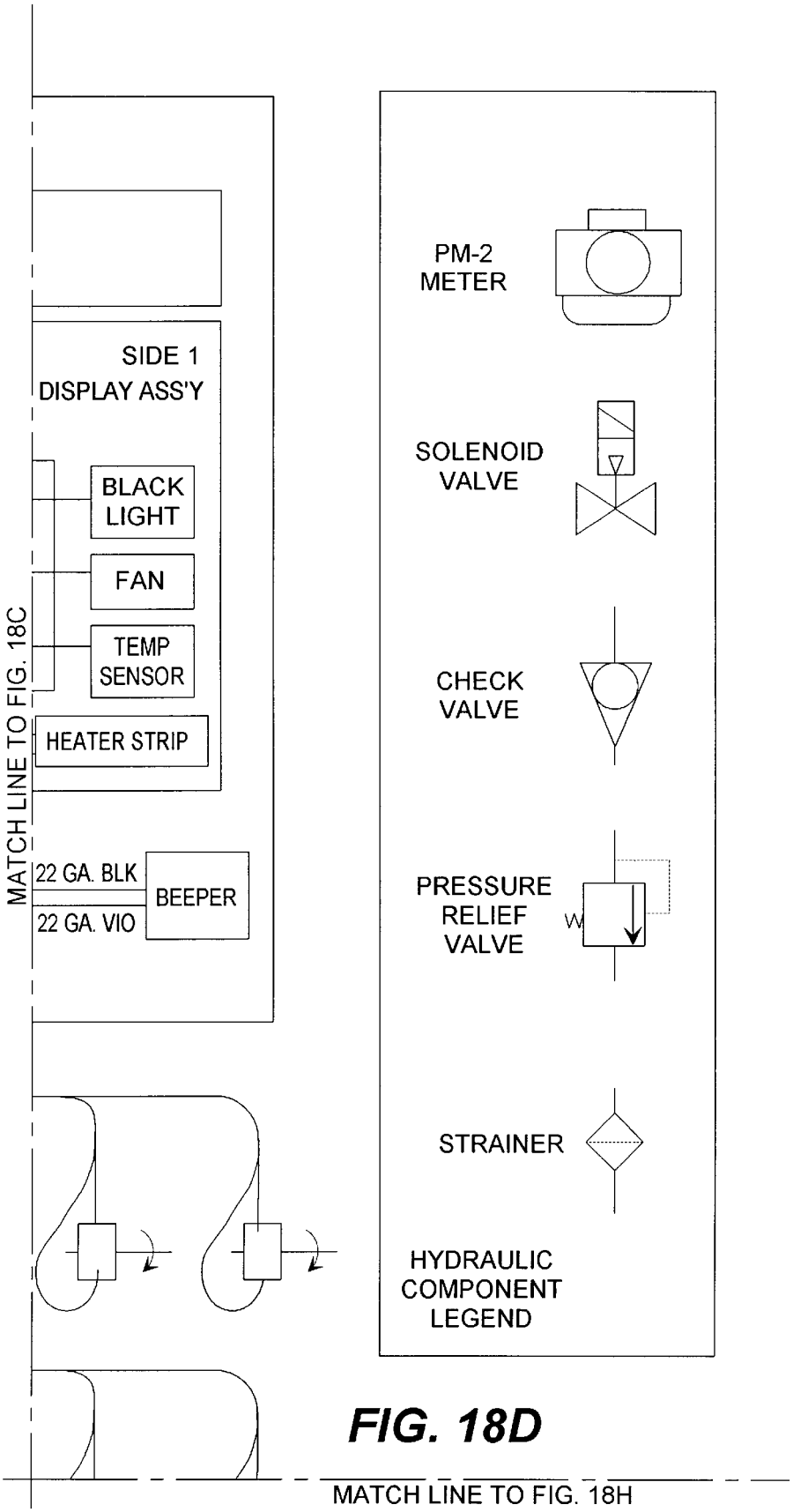
Figure 18E:
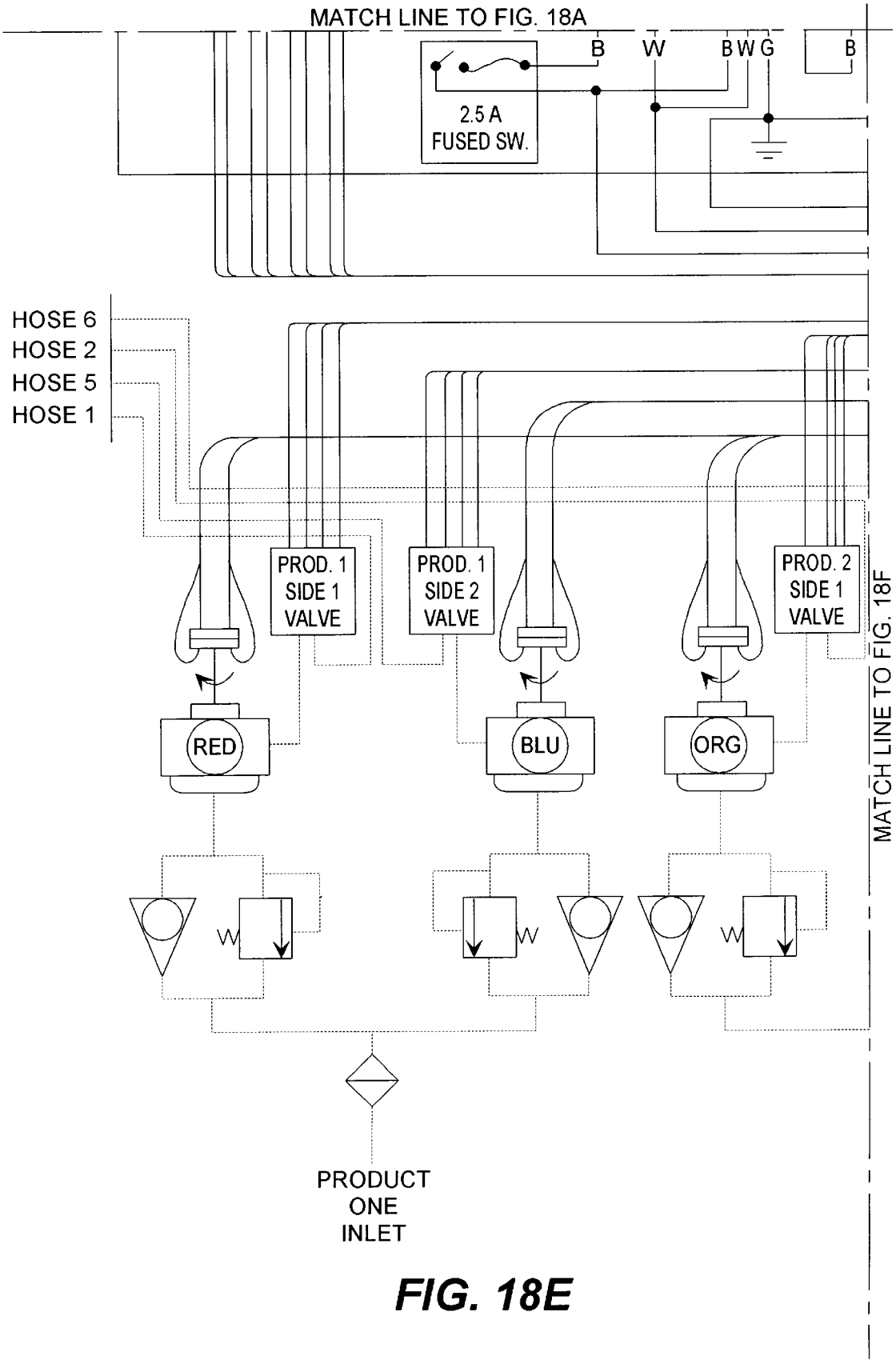
Figure 18F:
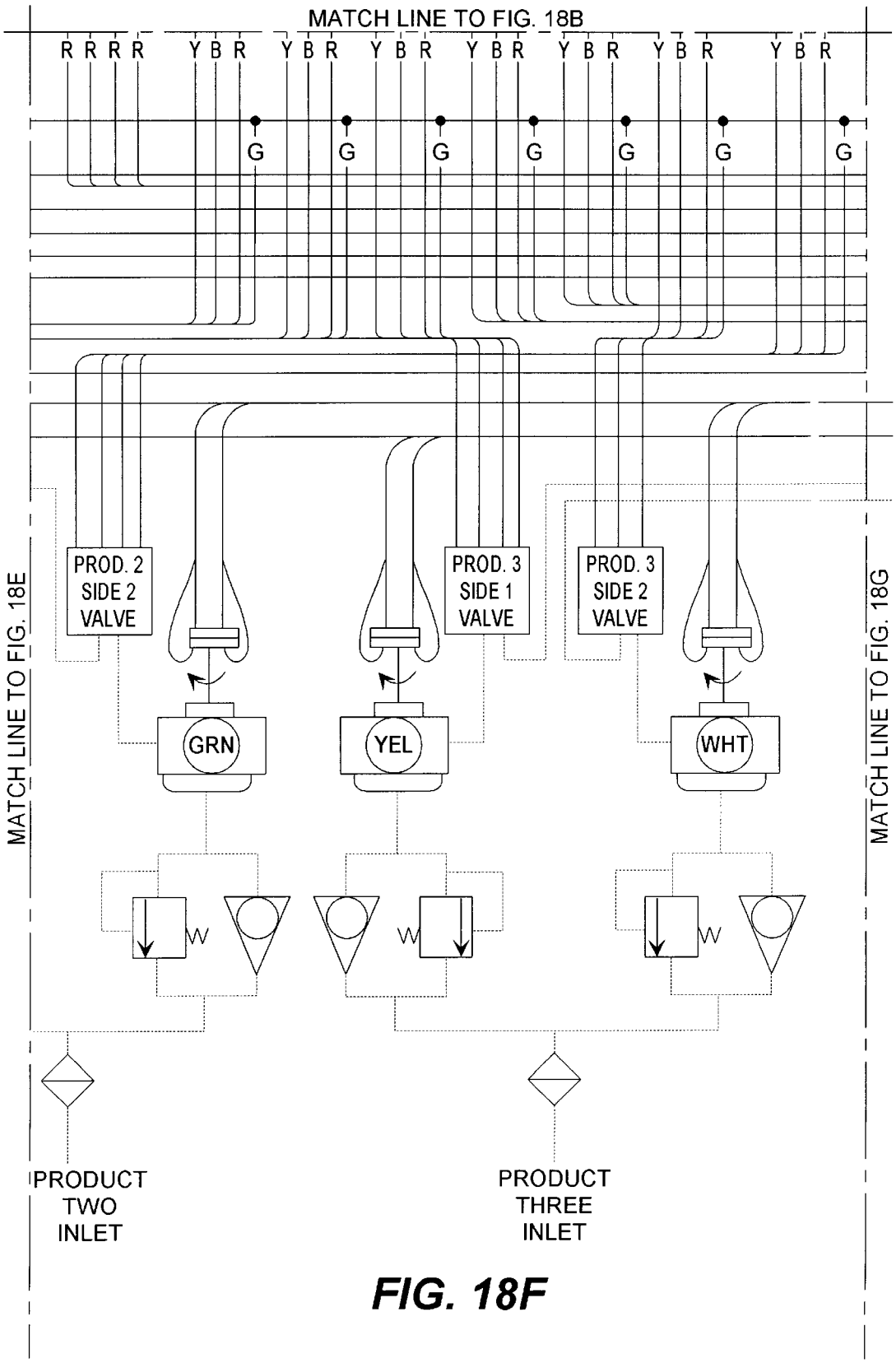
Figure 18G:
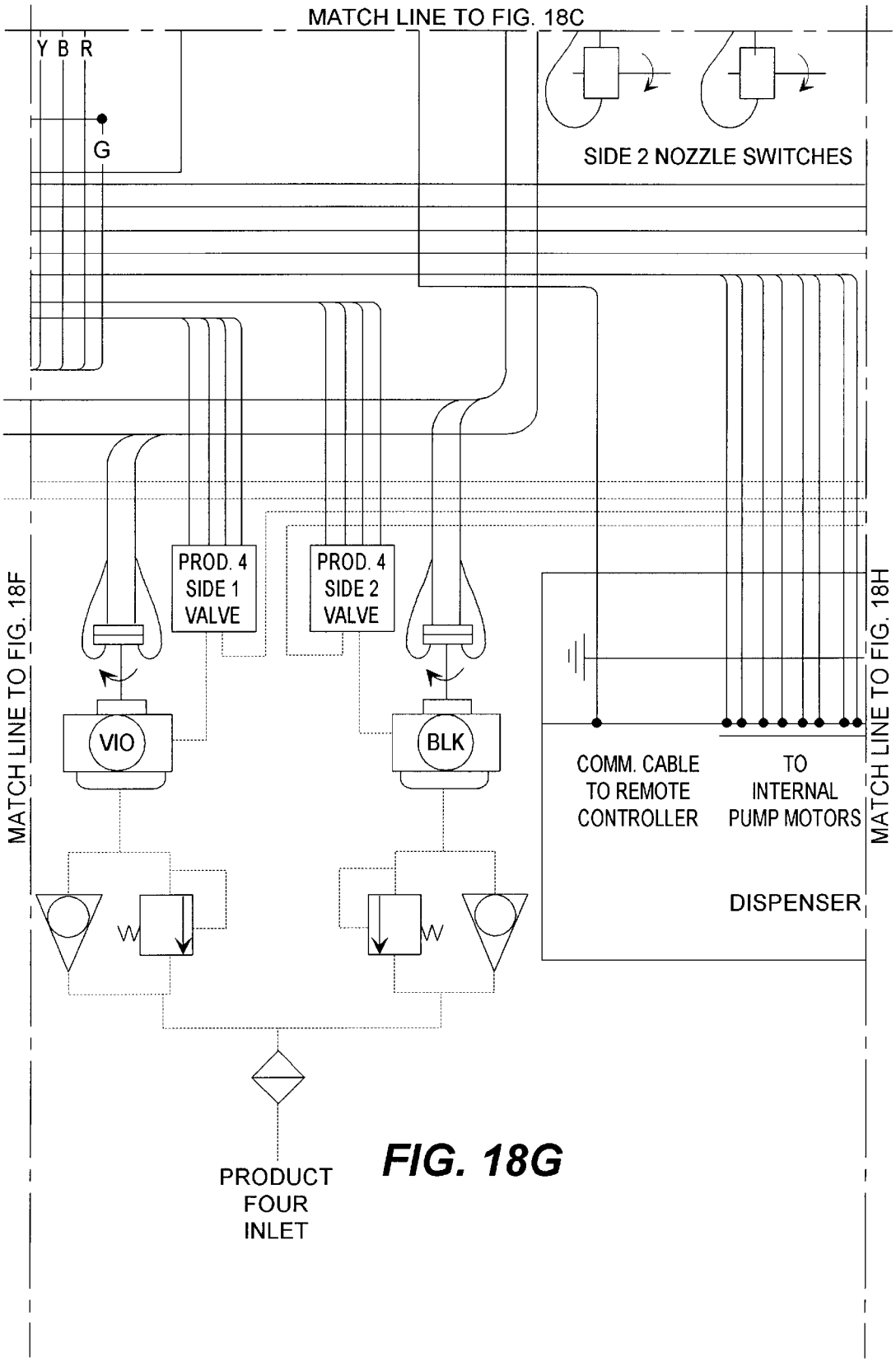
Figure 18H:
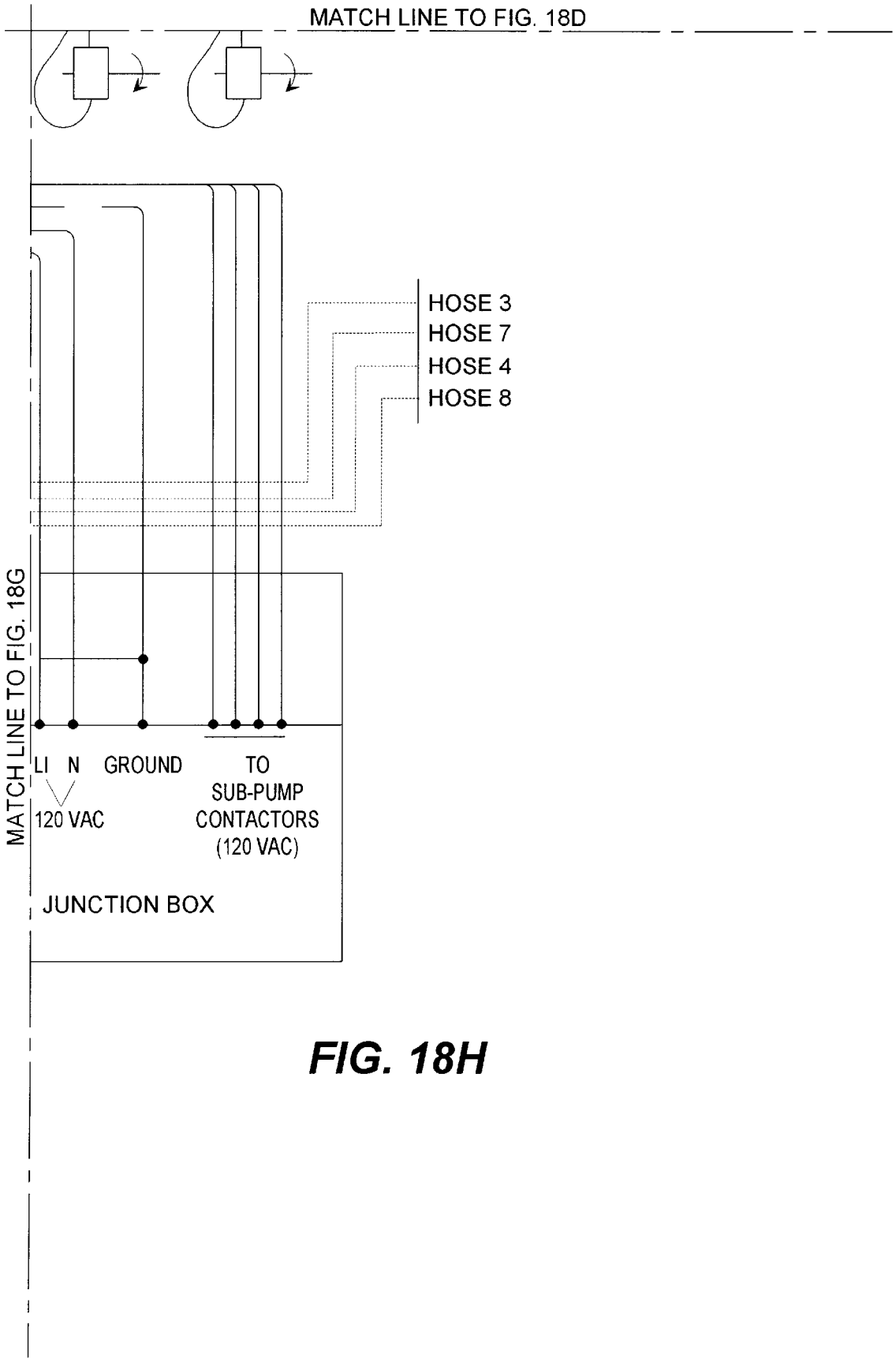
Figure 19:
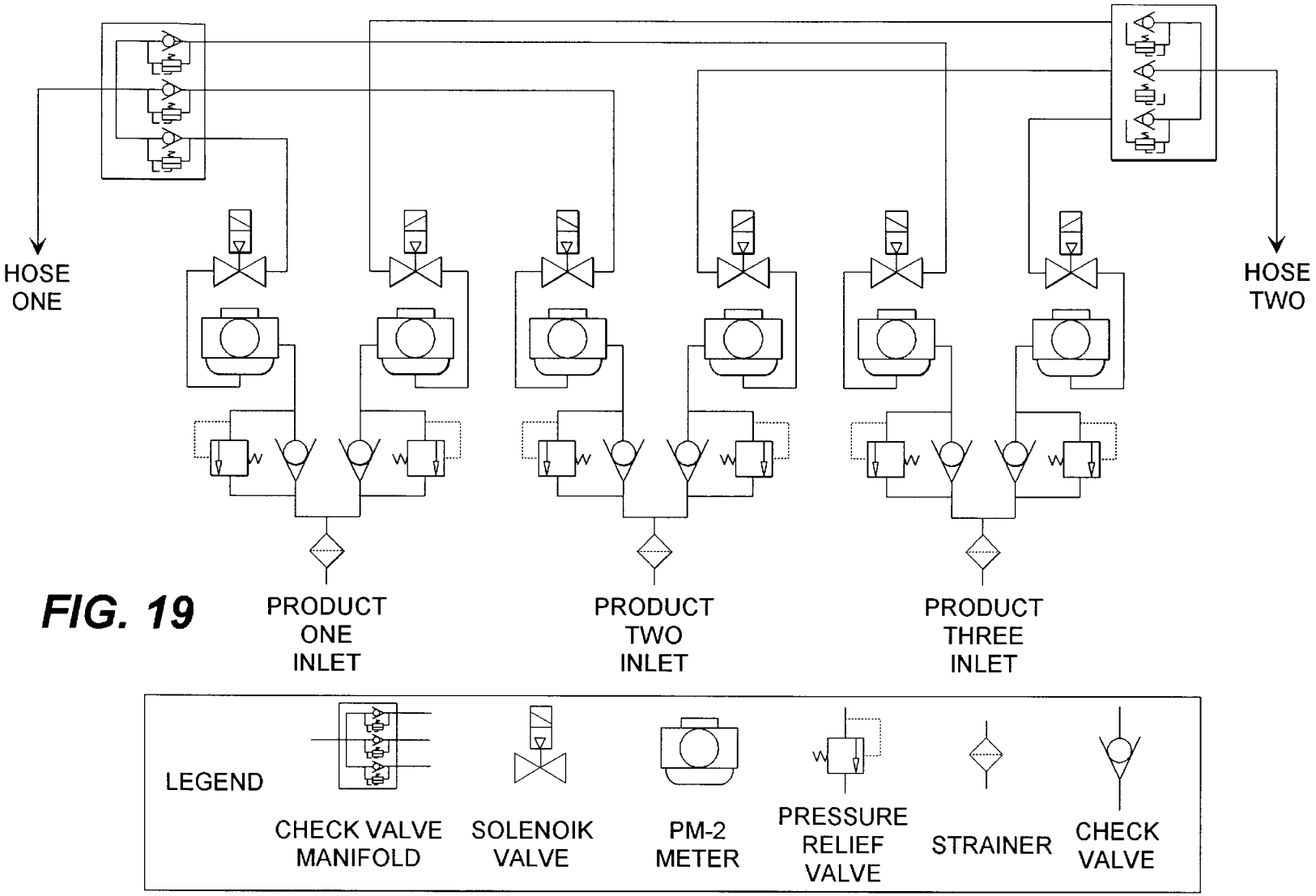
FIG. 19 is a schematic illustration of the control arrangement for the flow of fuel.

The function keys F1 through F8 can be assigned any of a variety of tasks, as dictated by the computer program installed in the computer 55. See FIGS. 14, 16–17. In one embodiment, key F1, with a prescribed display, functions as the money set key, which, when depressed, will permit the customer to preset the dollar amount of fuel to be delivered through manipulation of the numeric keypad; key F2 enables a preset, by gallons. Key F3 would bring on another screen to enable the display of $5.00, $10.00, $15.00 or "other" with pointers to keys F1, F2, F3 and F4, respectively, thereby enabling the customer to press one of the keys F1, F2, or F3 for the designated dollar amount of fuel to be delivered. Key F4 enables the customer to use the numeric keypad 31 for setting any dollar amount for the fuel to be delivered. Key F4 is also used to start the fuel delivery. Numerous screens showing diagnostic data, total sales and advertising data can be displayed on the display 30.

By appropriate connections to ports or terminals on the computer 55, a PC (not shown) at a remote station or a lap top computer (not shown) can be used to call up a program on computer 55, pull down data stored therein relating to the sales history of that dispenser or change the price of the fuel. The numeric keypad has numerals 0 through 9 and a "cancel" key so that a series of numbers can be entered to the computer 55, as desired.

Figure 3:
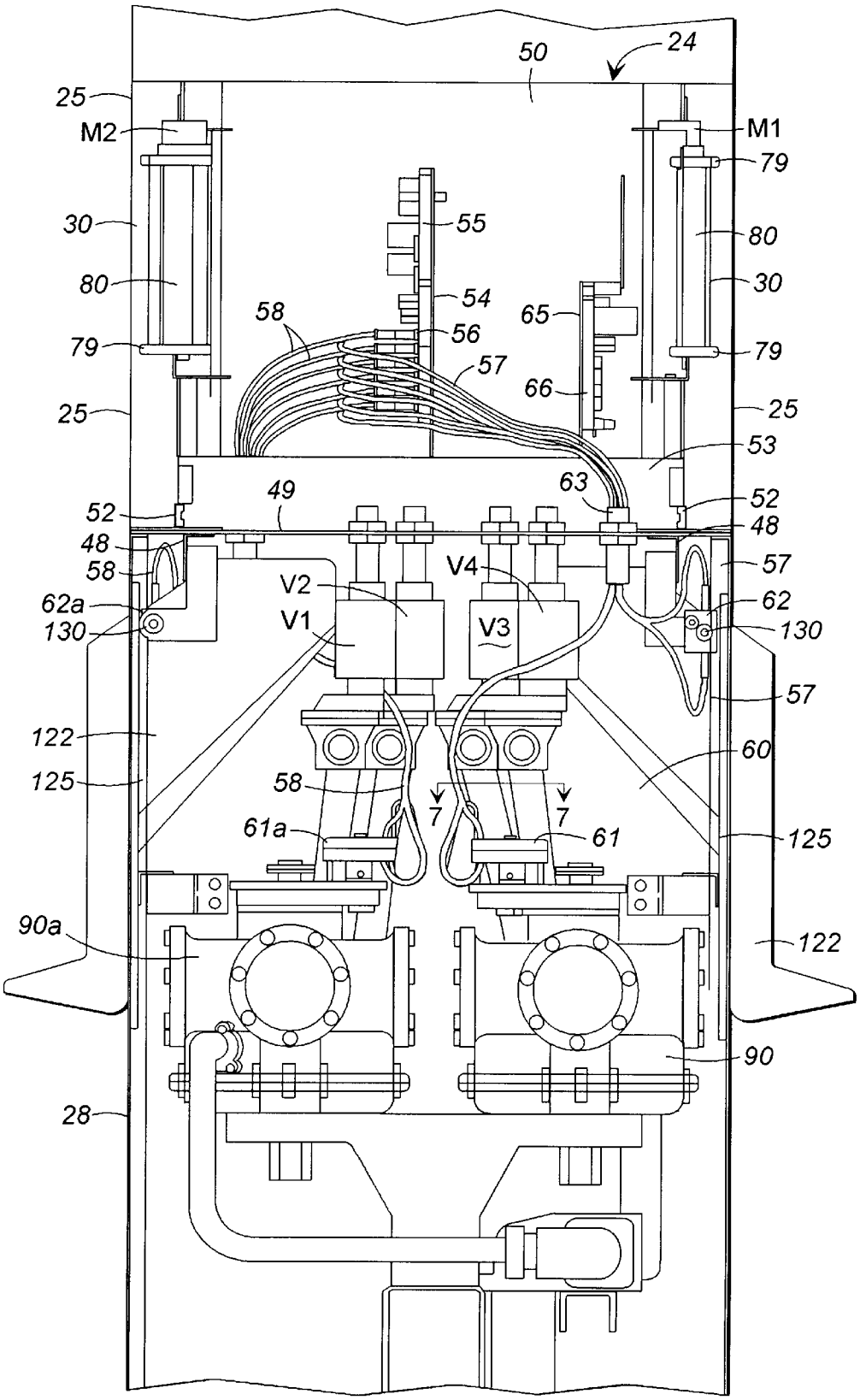
FIG. 3 is an enlarged vertical sectional view showing an inner portion of the dispenser shown in FIG. 1.

As seen in FIG. 3, the frame of housing 20 includes a pair of front and back, opposed, horizontal, angle iron, crossbars 48, disposed below the dispenser head 24. These crossbars 48 support a vapor barrier plate 49 which separates the interior of the housing 20 into an upper Class 1, Division II, dispenser head, area or chamber 50 and a lower hydraulic Class 1, Division I chamber or area 60. Mounted on the plate 49 are opposed, parallel front and back, upstanding brackets 52 of the frame which, in turn, support transverse partitions, such as partition 53.

An upstanding central panel 54 is carried between the partitions, such as partition 53 and this panel 54 supports the computer or main processor unit (M.P.U.) board 55. This computer 55 generates light and has fiber optic terminals 56, feeding this light to selected fiber optic cables in the cable groups 57 and 58. The fiberoptic terminals 56 are integrated into the computer board design. Of the six cables of the cable group 57, four of these cables lead to the fiber optic encoder or pulser, denoted generally by numeral 61, and two of the fiber optic cables lead to one fiber optic switch, denoted generally by numeral 62. In like fashion, four of the fiber optic cables of cable group 58 lead to the fiber optic encoder, denoted by numeral 61*a*, and two of them lead to the fiber optic switch 62*a*. The operation of these pulsers 61 and 61*a* and the switches 62, 62*a* will be explained in more detail hereinafter. Since these fiber optic cable groups 57 and 58 carry no electricity, but only light, they cannot short out against each other or cause a spark in the hydraulic chamber or area 60.

In passing through the barrier plate 49, cables of the cable group 57 can be bunched together and passed through a conduit seal, such as conduit seal 63 carried by plate 49. The cables of cable group 58 are also passed through a similar conduit seal (not shown). It will be understood that the cable group 57, pulser 61 and switch 62 relate to the fuel delivery from the front side of the dispenser, while the cable group 58, pulser 61*a* and switch 62*a* relate to the fuel delivery at the rear side of the dispenser. Both deliveries are controlled by the common computer 55.

Figure 6:
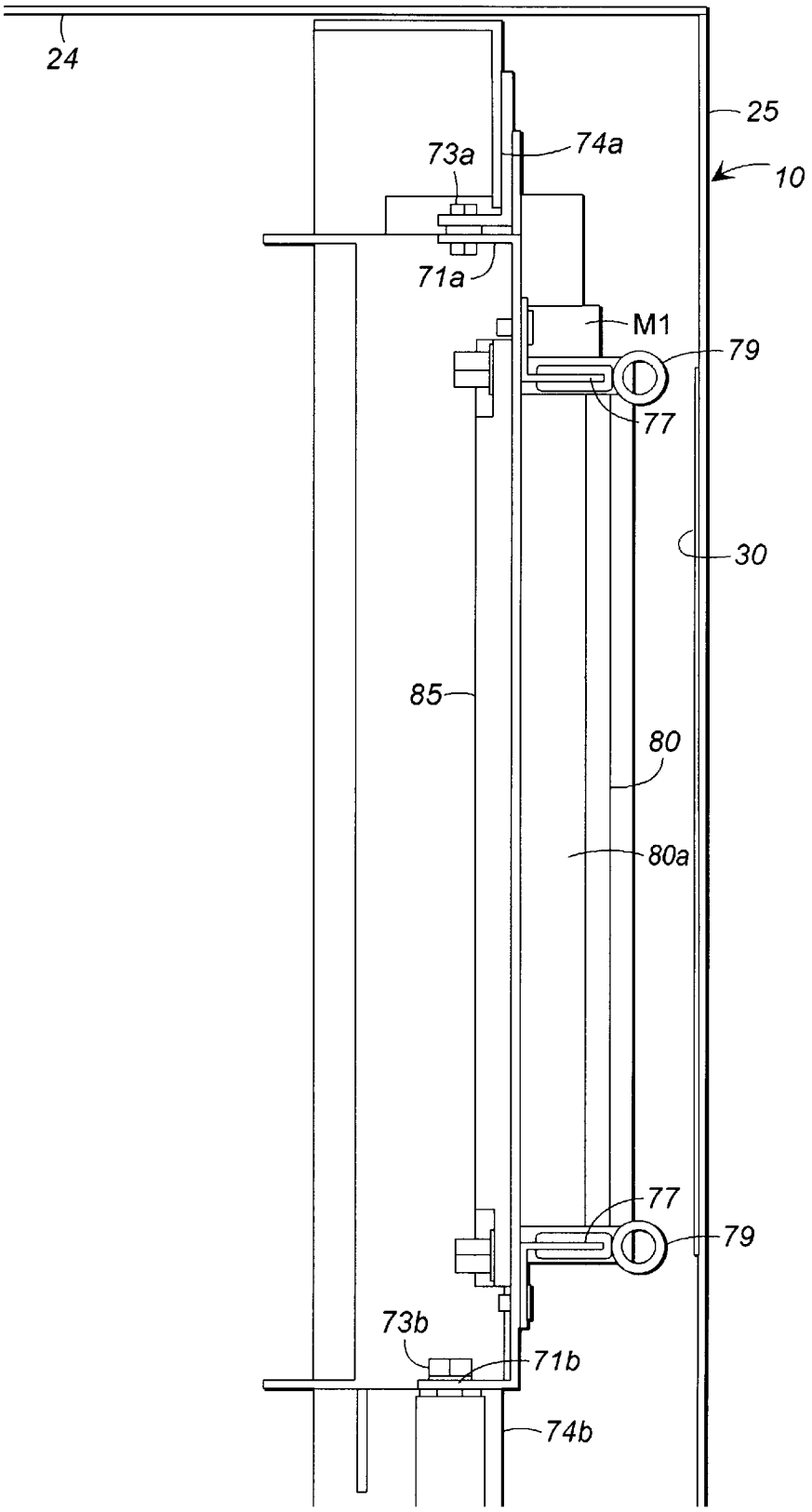
FIG. 6 is a vertical sectional view of the display assembly shown in FIGS. 4 and 5.

Within the upper or dispenser head chamber or area 50 is a display assembly 70 which includes a pivotable display frame 71 having inwardly turned upper and lower spherical flanges 71*a* and 71*b*, the ends of which are provided with vertically aligned holes, such as holes 72, through which aligned pivot bolts 73*a* and 73*b*, seen in FIG. 6, pass, the bolt 73*a*, in turn, being supported in an upright position by a crossbar 74*a* and 74*b* of the inner frame of the dispenser 10. The display frame 71 is thus free to pivot, as indicated by arrow 75, in FIG. 4, about bolts 73*a* and 73*b*.

Figure 4:
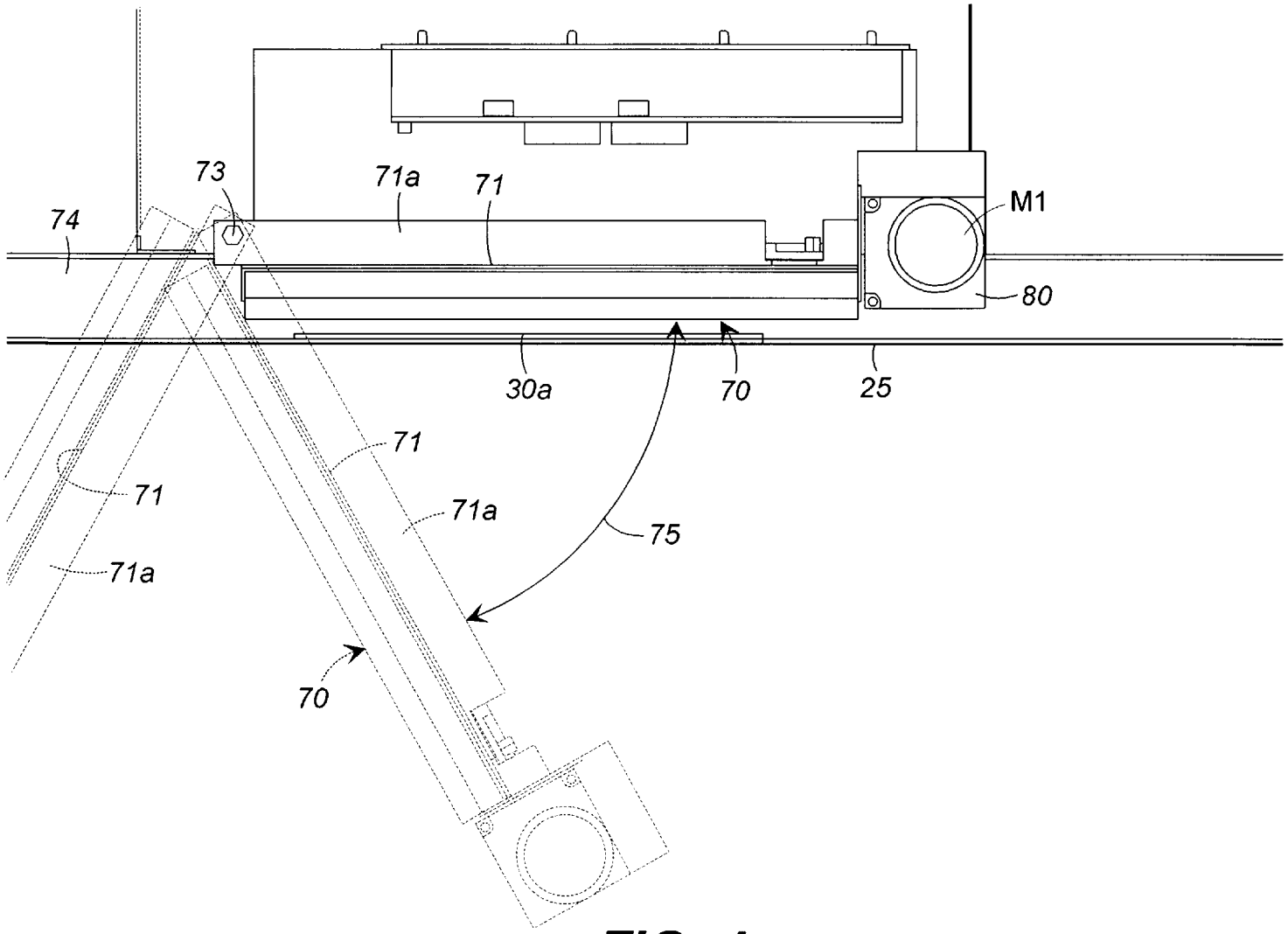
FIG. 4 is an enlarged horizontal sectional view of a portion of the dispenser shown in FIG. 1 and showing the display swing-out and fan assembly, the display assembly being shown in full lines in its closed position and in broken lines in its opened positions.
Figure 5:
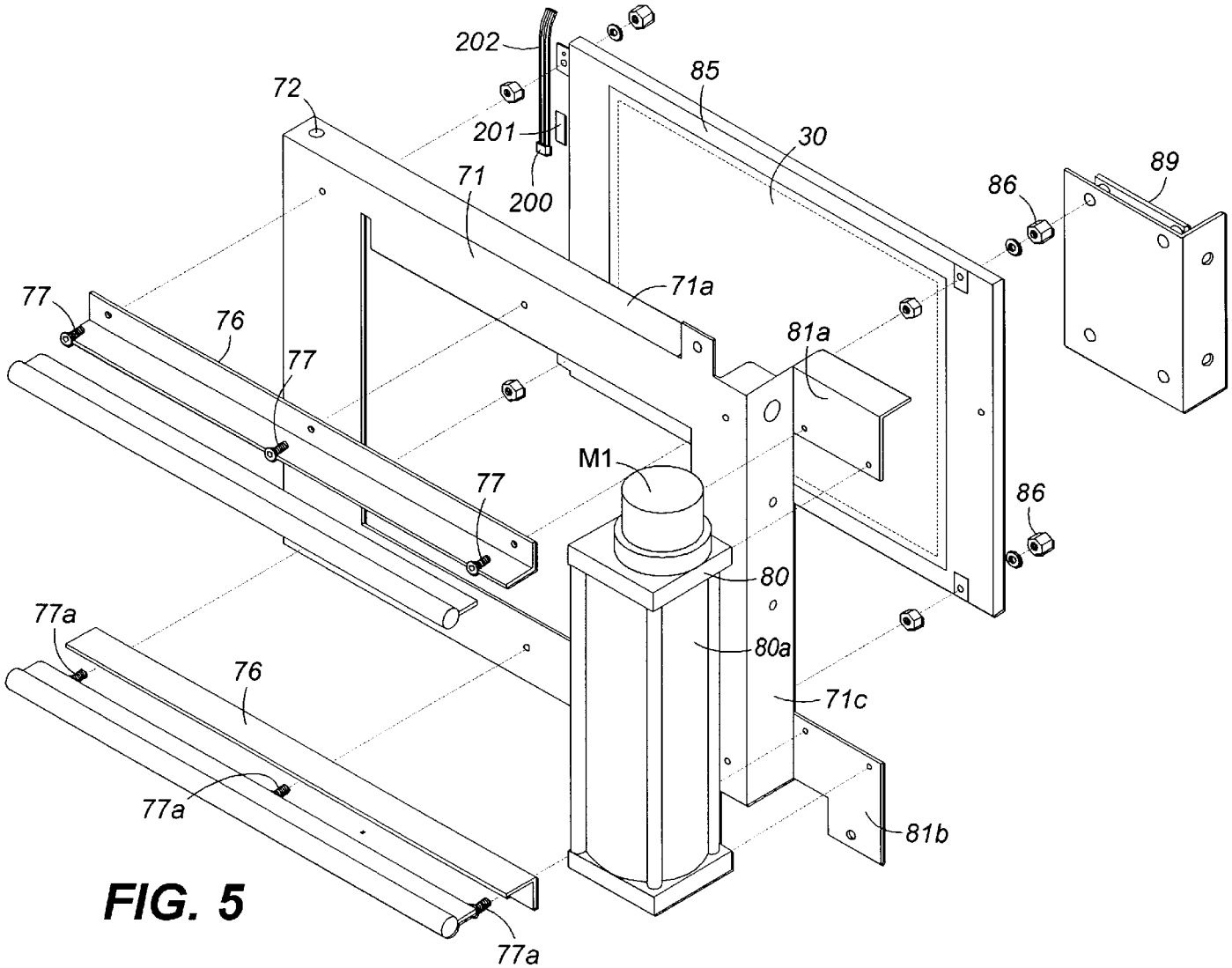
FIG. 5 is an enlarged exploded perspectiveview of the display assembly of FIG. 4.

As seen best in FIGS. 4, 5 and 6, each frame 71 carries a pair of opposed horizontally extending, angle iron air guides 76 mounted by bolts 78 to frame 71. The edges of the flanges of the air guides 76 respectively receive gaskets 79 which is adjacent to the inner surface of the window 30*a* at its upper and lower edges, when the display 30 is operating.

A display cooling fan 80, driven by motor M1, creates a flow of air in a horizontal direction between the air guides 76 and across the face of the fuel crystal display 30. The temperature of the liquid crystal display 30 is controlled by a heater and a fan working in conjunction to maintain no more than 5 degrees Fahrenheit temperature variation across the entire surface of the display. A noticeable contrast difference can be seen on the display when a temperature variation of more than 5 degrees Fahrenheit temperature variation occurs. The cooling fan is a 45 cfm cross flow squirrel cage fan operated by an integral 12V, 7 Watt DC motor and is used to remove the heat build-up in the LCD panel from external sources, mainly radiant energy from the sun. Attached to the rear of the panel is a 25 Watt, 120 VAC heater strip. The heater can maintain the LCD panel temperature to less than 10 degree Fahrenheit under normal operating conditions. The LCD tends to become very sluggish to changes below 10 degree Fahrenheit. A temperature sensor is mounted directly to the LCD panel to record surface temperature. Contrast (backplane voltage) and consequently, readability is controlled by the computer (55) with more contrast needed at higher temperatures. Lighting of the display is accomplished by an integral backlight in the LCD panel. Cooling fan 80 has an elongated upright rotary centrifugal rotor having a hollow interior and spaced parallel axially extending vanes 80*a* which rotated about a vertical axis in an orbital path. The fan 80 and its motor M1, or M2, as the case may be, are carried by opposed, vertically spaced, bracket 81*a*, 81*b*, seen in FIG. 5, the brackets 81*a*, 81 *b* protruding from a side flange 71*c* on frame 71.

The bolts 77 protrude through the frame 71 and receive and secure a backing plate 85 of the transflective fuel crystal fuel display 30, in place against the inner surface of frame 71. Spacers 87 and nuts 86 are received on bolts 77 to retain plate 85. Rearwardly of the plate 85 is a peripheral interface assembly 89 forming a part of the electrical circuitry is rearwardly of the plate 85.

Panel 65 carries power supply to the computer 55, and to the fan motors M1 and M2 and controls the solenoid valves V1, V2, V3 and V4. Panel 65 also forms a heat sink for the power supply board 66.

Figure 7:
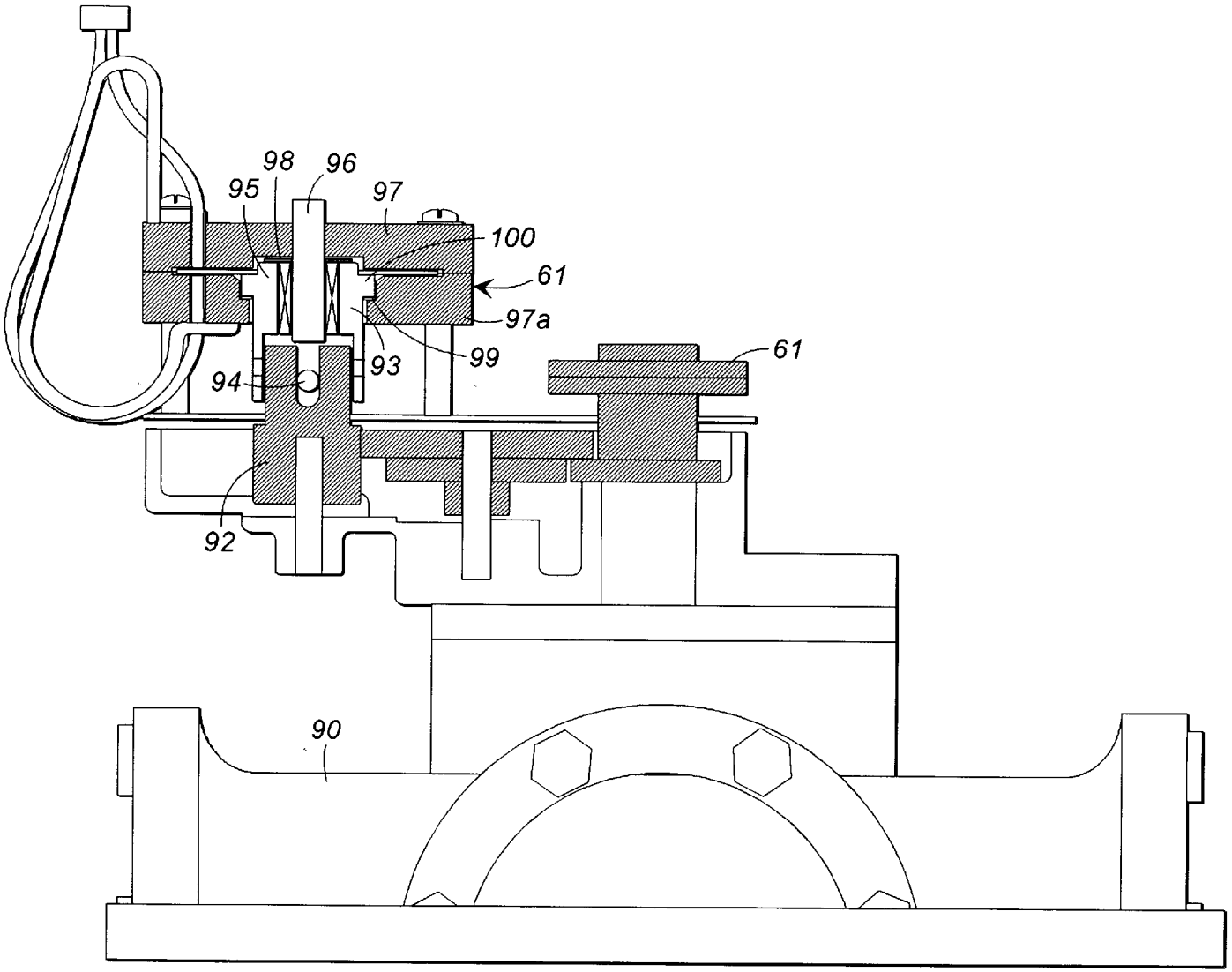
FIG. 7 is an enlarged vertical sectional view taken substantially along line 7—7 in FIG. 3 and showing the fiber optic pulser of the dispenser shown in FIG. 1.
Figure 8:
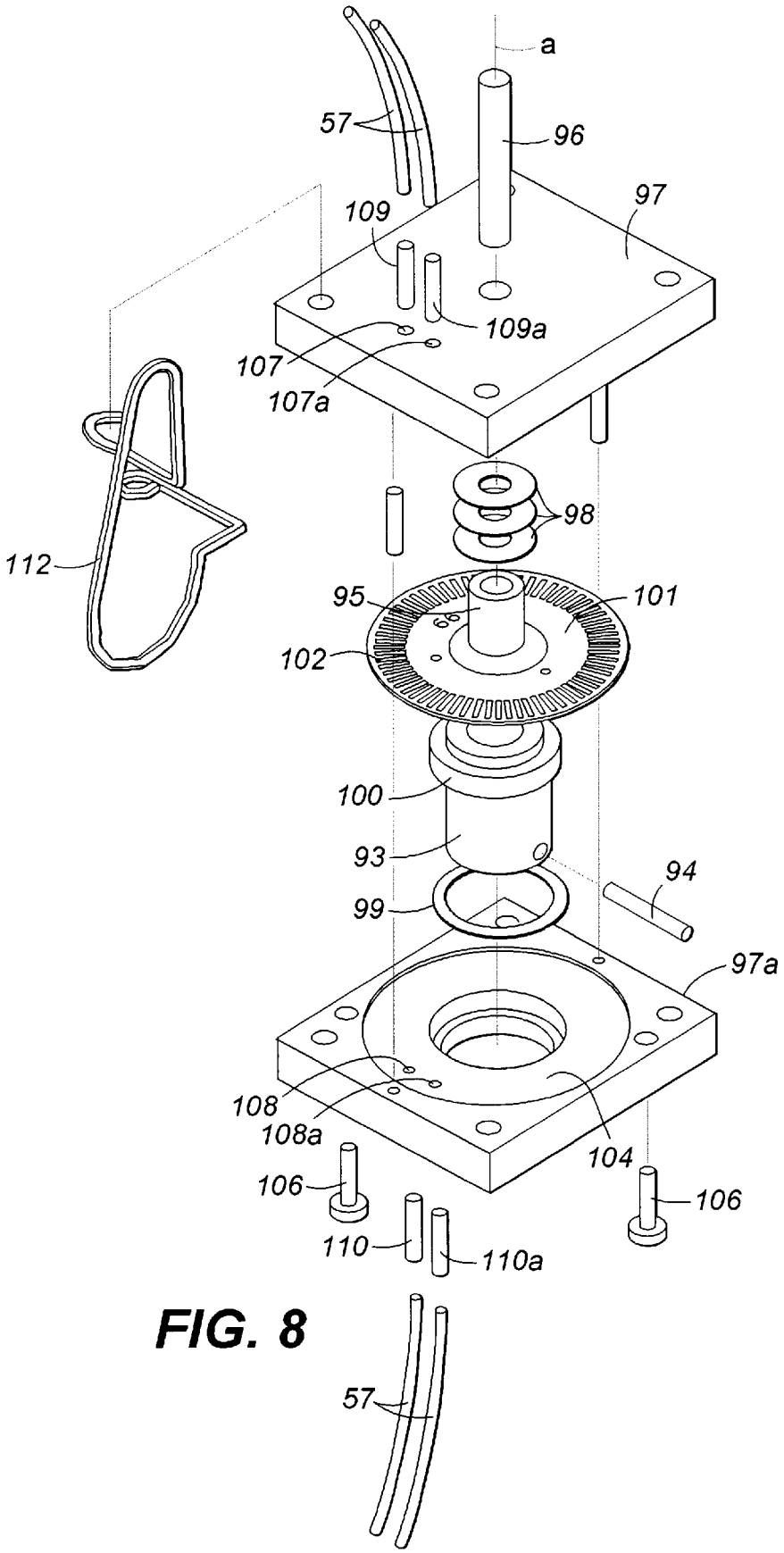
FIG. 8 is an exploded perspective view of the pulser shown in FIG. 7.
Figure 9:
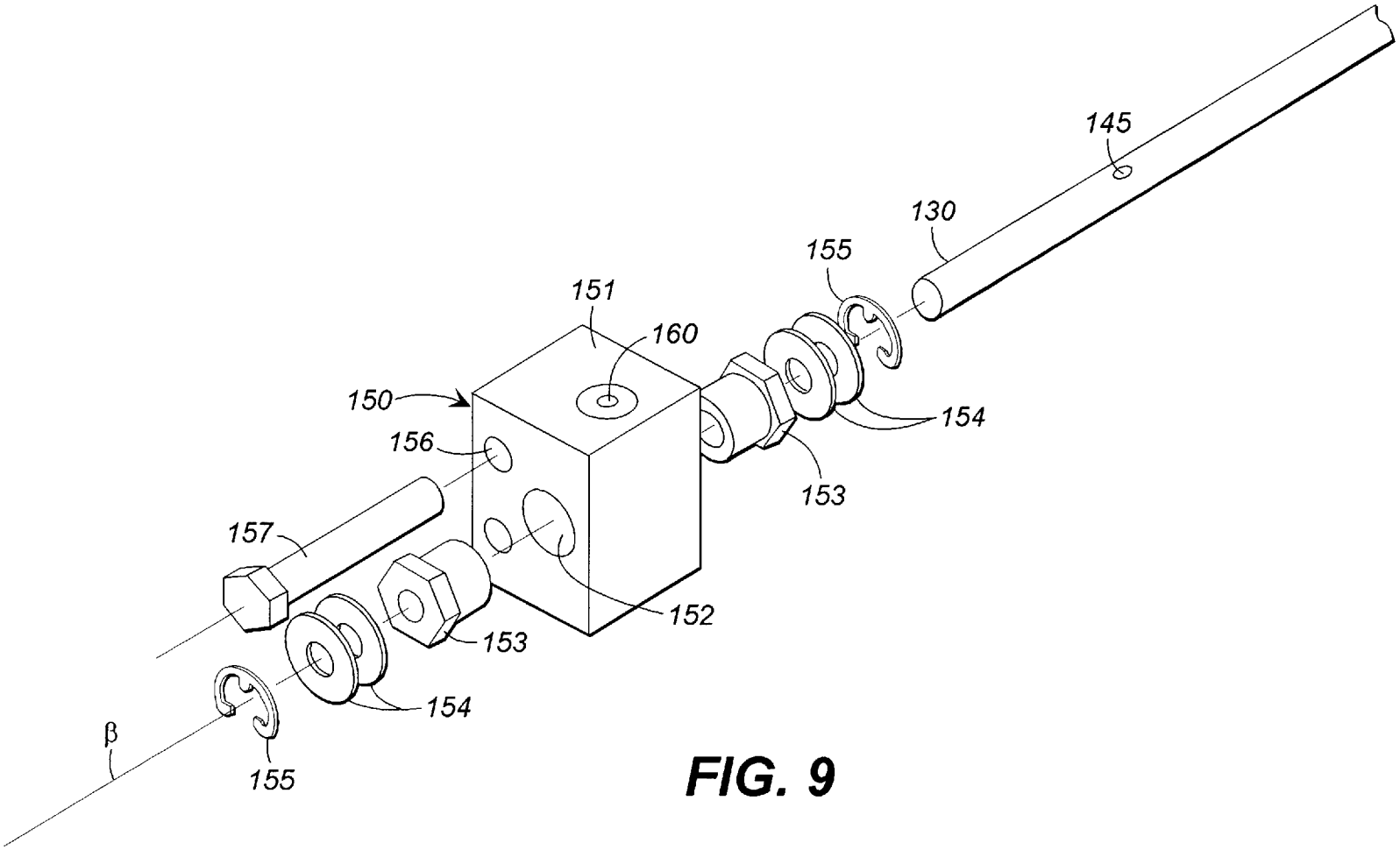
FIG. 9 is an exploded perspective view of the fiber optic switch assembly of the dispenser shown in FIG. 1.
Figure 10:
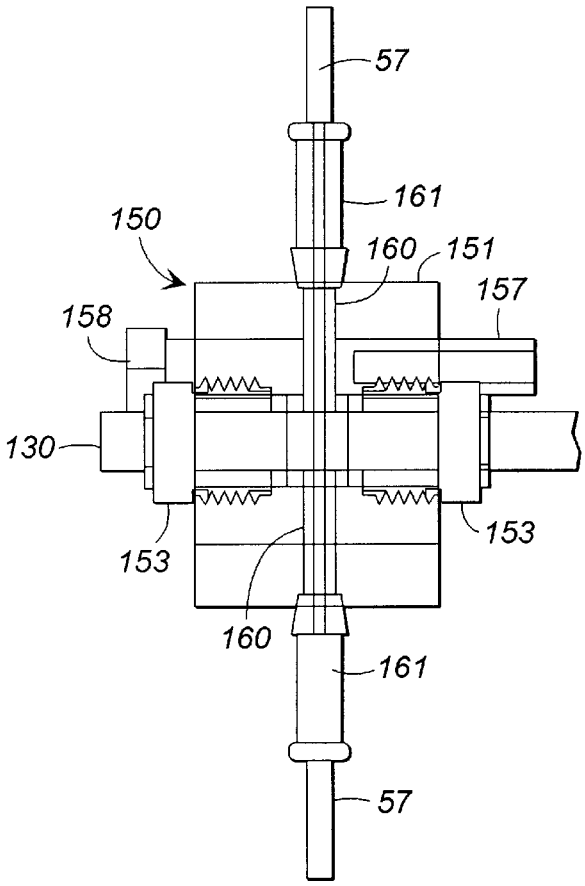
FIG. 10 is an enlarged cross-sectional view of the fiber optic switch shown in FIG. 9.
Figure 11:
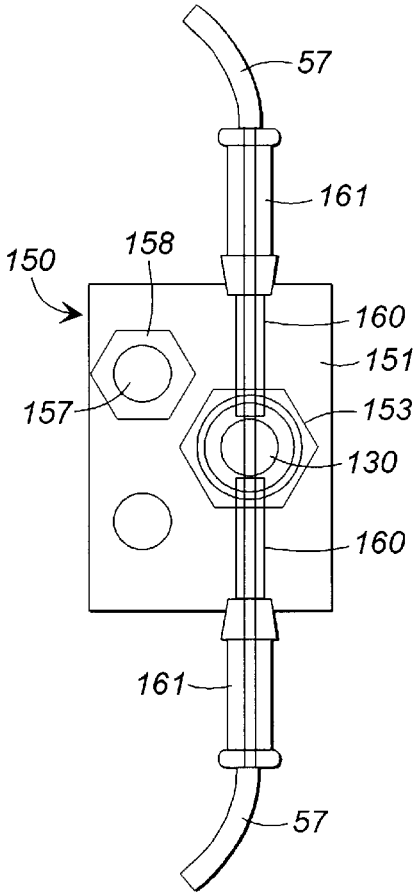
FIG. 11 is an end view of one end of the fiber optic switch shown in FIG. 10.
Figure 12:
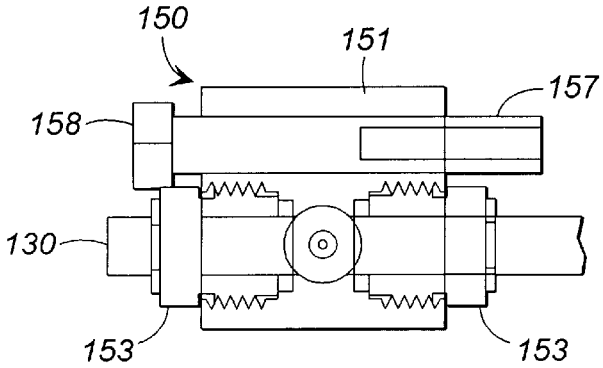
FIG. 12 is an side view of the fiber optic switch shown in FIG. 10.

In FIGS. 7 and FIG. 8 the dual channel, full quadrative fiber optical pulser or encoder 61 as illustrated in detail. The function of the pulser 61 or 61*a* is to deliver signals, via the cables 57 and 58, as the case may be, to computer 55, indicative of the volume of fuel passing through the PM2 meter 90 or 90*a*, the fuel being delivered by a submerged pump or pumps (not shown) which is controlled by computer 55. The PM2 meter is a four piston positive displacement meter. The meter 90, 90*a* measures the volume of fluid passing therethrough at any flow rate from 0–25 GPM. The meter 90, 90*a* produces approximately 15.14 output revolutions per gallon of gas flowing through the meter. The timing disc 101 is attached directly to this output shaft and has 66 slots 102 in it which provides for 1000 slots passing by the beam of light per gallon of gas through the meter. The PM2 meter is adjustable so as to give exactly 1000 slots/gallons. Consequently, each pulse is worth $1/1000$ of a gallon of gasoline (or $1/264$ of a liter of gasoline). The "deliver signal" to the computer 55 is an individual pulse of light for which the computer has to account. The pulser 61, 61*a* each produce identical pulses on two channels to allow the computer 55 to compare one channel to the other for the purpose of error checking. The upper end of output shaft 91 of PM meter 90 protrudes upwardly from meter 90 and is received in the annular hub 92 of the rotor 93 of pulser 61, being coupled thereto by a drive pin or sheer pin 94. The rotor 93, in turn, is journaled by an anti-backlash bearing 95 on a stationary downwardly protruding central shaft central shaft 96 carried by the upper pulser housing 97. Thrust washers 98 on shaft 96 between the housing 97 and bearing 95 prevent appreciable upward movement of bearing 95.

A lower annular thrust bearing 99, received on an annular shoulder of the lower housing 97*a*, supports a annular peripheral ring 100 integrally on rotor 93. A thin annular timing disc or interrupt wheel 101 having a plurality of equally spaced radial slots 102, adjacent to the outer periphery of disc 101, is fixed concentrically on the upper surface of shoulder 100. Disc 101 is received in opposed circular recesses 104 in upper housings 97 and lower housing 97*a*. Bolts 106 removably secure the upper housing 97 and lower housing 97*a*, together. The disc 101 is rotated by movement of fuel through meter 90 or 90*a*. The disc 101 has spaced apertures 102 defined therein for successively interrupting light passed from certain of cables 57 and for thereby permitting delivery of successive light through certain other of cables 57.

The upper housing 97 is provided with two circumferentially adjacent spaced holes 107, 107*a*, which overly the path of slots 102, but are out of phase with the slots 102. In like fashion, holes 108, 108*a* are provided in lower housing 97*a* so as to be aligned axially respectively with holes 107, 107*a*.

Holes 107, 107*a*, 108, 108*a* respectively receive fiber optic cable end inserts 109, 109*a*, 110, 110*a*. Fiber optic cables 57 are respectively connected to the cables and inserts 109, 109*a*, 110, 110*a* to form two channels, out of phase with each other. Light transmitted from computer 55 supported by inserts 109, 109*a* and the light pulses are received by two other cable ends supported by inserts 110, 110*a* when successive slots uncover the cable ends 109, 109*a*. These pulses are transmitted via such that the cables 57 back to the computer 55, but such light pulses are 180° out of phase with each other.

Cable supports 112 on housings 97, 97*a* hold the cables 57 in appropriate positions. Pulses are received by the computer 55 causing the dollar, volume, and English or metric volume amounts of fuel delivered to show on the display 30 without any danger of electrical discharges being generated from the pulser 61 or 61*a* within the hydraulic area 60.

Delivery of the grade of fuel from the meters 90 and 90*a* is controlled by the solenoid valves V1, V2, V3 and V4 so that three different grades of fuel can be delivered selectively via one hose 120 to one nozzle 121, the middle grade being achieved by blending fuel received from two meters such as meters 90 or 90*a*. The computer 55, which receives signals from such meters, can dictate the coordinated partial opening and closing of solenoid valves V1 and V2 to achieve the blended fuel for one nozzle 121 and solenoids V3 and V4 to achieve blending for a different nozzle 121. The solenoid valves are 115 VAC solenoid actuated, pilot operated, diaphragm type valves that are commonly used by manufacturers in the art. Any blending is done in a special configuration of the dispenser by way of a pressure compensated, fixed orifice, (fixed ratio) blending device which is commonly, as known to those skilled in the art.

In FIG. 1 and FIG. 3 it is seen that the nozzle boots 122 and 122*a* are respectively received flat against the outer surfaces of the opposed dispenser doors 28.

The nozzle boots 122 are disposed in opposite doors 28 for cradling the nozzles, such as nozzle 121, seen in FIG. 1. Boots 122 are identical, each having a forwardly opening mouth 122*c* and each being shaped to receive several sizes of nozzles, such as nozzle 121 through mouth 122*c* and into recess 122*d* until the nozzle 121 is in a fully inserted position, so that the trigger guard 121*a* of nozzle 121 rests on the lower ledge 122*b* of the boot 122, as shown in FIG. 1.

Figure 13:
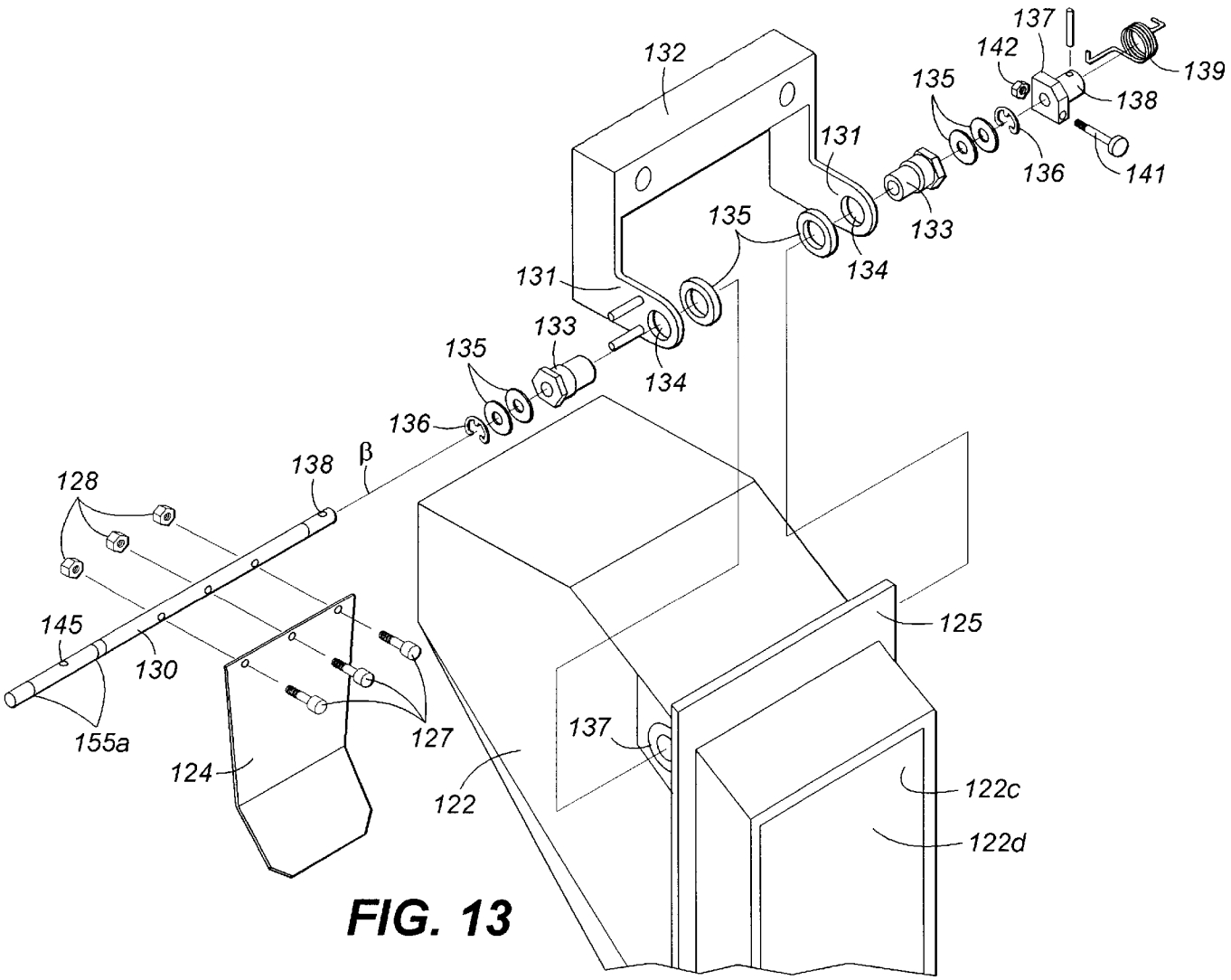
FIG. 13 is an enlarged exploded perspective view of the boot assembly of the dispenser shown in FIG. 1.

The boot 122 is generally a rectangular and upwardly, inwardly tapering casing which receives, within its recess 121*c*, the flapper 124 seen in FIG. 13. As a nozzle, such a nozzle 121 is inserted into the recess 122*c*, the discharge end of the nozzle 121 will engage the flapper 124 and pivot the flapper 124 inwardly so that it rotates about axis β, as will be explained later. When the nozzle 121 is fully inserted into the boot 121, the nozzle 121 will be retained by boot 122 in an upwardly and inwardly inclined position.

An integrally formed flange or frame 125 surrounds the mouth portion of the boot 122 so that when the boot 122 is installed, the mouth portion protrudes through a rectangular opening in the door 28, as seen in FIG. 1. The flange or frame 125 is then bolted to the door 28 when the door 128 is closed.

The boot 122 is rotatably suspended at its upper front portion, rearwardly adjacent to frame 125, on a shaft 130, best seen in FIG. 13, so that, when the door 28 is opened, the boot 122 can be pivoted about axis β of shaft 130 from its normal position, shown in FIG. 3, outwardly and upwardly to a raised position in which frame 125 is essentially horizontal. The purpose of this pivoting is to permit easy access to the hydraulic area 60.

On the inside of the boot 122 the flapper 124 is bolted by bolts 127 to shaft 130, the bolts 127 being retained by nuts 128. The shaft 130, itself, is supported by downwardly and outwardly extending L shaped arms 131 of a bracket 132, the arms 131 receiving bushings 133 which, in turn, pass through holes 134 in arms 131 and through washers 135. Washers 135 and E-clips 136 receive in peripheral grooves in shaft 130, arrest any appreciable axial movement of shaft 130.

At one outer end portion of shaft 130 is a clamp 137 having a collar 138 around which is a helical spring 139, one end of which protrudes into a radial hole 138 in shaft 130. The other end of spring 139 is retained by a clamp/spring retainer received on shaft 130. The retainer, when fitted on shaft 130, can be rotated to tighten or loose the spring and is generally rectangular or square along its perimeter. A bolt 141 and nut 142, when tightened, clamps the retainer 137 in place on shaft 130.

The purpose of spring 139 is to bias the shaft 130 so as to urge the flapper 124 to a yieldable, spring, biased, position within boot 122 so that when the nozzle 121 is moved into the boot 122, the discharge end of nozzle 121 will engage the flapper 124 and urge it against spring bias, into a rotated position, thereby rotating the nozzle switch shaft 130 to a rotated position.

On the opposite end portion of a shaft 130 from spring 139 is a radial hole 145 through the nozzle switch shaft 130. Surrounding the radial hole 145 is a fiber optic switch 150, seen in FIGS. 9, 10, 11 and 12. The switch 150 has a right cubic parallel piped block or body 151 with a main bore 152, through which shaft 130 projects. Opposed fiber optic switch bushings 153 are threadedly received in the opposite end portions of bore 152, journaled through shaft 130 while thrust washers 154 and E-clips 155 received on shafts 130 center the end portion of shaft 130 so that hole 145 is midway in hole 152, within the block or body 151. The E-clips 155, which are received in spaced grooves 155*a* in shaft 130 to assure that the hole 145 of shaft 130 remains so centered.

Parallel to axis β of bore 152 and offset therefrom is a second hole or bore 156, through which a switch body retainer 157 projects. This switch body retainer 157 is loosely received in hole 156 and is anchored to the frame of dispenser 10. The retainer 157 permits limited rotary movement on shaft 130. Shaft 157 has a hexagonal nut 158 on its outer end.

Aligned holes 160 in block 151 are perpendicular to the bore 152 and shaft 130 and intersect bore 152 at hole 145 on shaft 130.

The end portions of two fiber optic cables 57 project into the opposed holes 160 and are retained in place by cable retainer 161. The computer 55 provides light to one of the cables 57 and when the shaft aligns hole 145 with the ends of the two cables 57, light from the end of one cable 57 will be received by the other cable for being returned to the computer 55. When the shaft 130 is rotated so as to misalign the hole 130 the light beam from one cable end to the other will be interrupted. Thus, the fiber optic switch 150 detects whether or not a nozzle 121 has been received in boot 122 since the shaft 130 is rotated to misalign the hole 145 with the ends of cables 57.

The shaft 130 need not be entirely straight along axis β since the switch floats sufficiently to not be effected by such misalignment. Since fiber optics carry no current, there is no danger of its creating an electrical spark in hydraulic area 60.

One feature of the present invention is the temperature probe 200, shown in FIG. 5. Probe 200 is carried adjacent to the display 30 in a recess 201 on plate 85 and is electrically connected by wires 202 to the computer 55. When a temperature rise is detected, the probe 200 will provide a signal to the computer 55 causing it to increase the voltage bias on the display 30 and thereby automatically maintain an appropriate contrast for the display 30.

It will be obvious to those skilled in the art that many variations may be made in the embodiment chosen for illustrating the preferred embodiment of the invention, without departing from the scope thereof.

We claim:

1. A fuel dispenser comprising:

(a) a housing;

(b) a fuel discharge conduit for said housing;

(c) a discharge nozzle externally of said housing for delivering fuel from said fuel discharge conduit;

(d) a barrier in said housing for dividing said housing into an upper chamber and a lower chamber;

(e) a valve in said housing communicating with said fuel conduit;

(f) a computer in said upper chamber;

(g) a source of fuel;

(h) a meter in said lower chamber connected to said source of fuel and to said valve for monitoring fuel passing through said meter to said valve;

(i) supply conduit means connected to said meter for delivering fuel from said meter;

(j) a fiber optic transducer connected to said meter;

(k) a first set of fiber optic cables connecting said computer and said transducer for providing optical signals delivered through said optical cables to said computer, said signals being indicative of the flow of fuel monitored by said meter;

(l) said computer generating signals for controlling said valve;

(m) a nozzle boot on said housing for receiving said nozzle when said nozzle is not in use;

(n) a fiber optic switch for detecting when said nozzle has been received by said boot; and (o) a second set of fiber optic cables connected between said switch and said computer for transmitting a light signal for indicating whether or not said nozzle is received in said boot and for causing the computer to dictate the closing of said valve.

2. A fuel dispenser, the fuel dispenser having a housing, a supply of fuel, a fuel pump in fluid communication with the supply of fuel, and at least one fueling hose for dispensing fuel therethrough, said fuel dispenser comprising:

(a) a computer positioned within the housing of the fuel dispenser, said computer including a fiber optic light source emitting a fiber optic light beam;

(b) a meter in said housing, said meter being constructed and arranged to meter the flow of fuel passed therethrough during use of the fuel dispenser;

(c) a flow control valve in said housing, said valve being in fluid communication with said meter and being constructed and arranged to control the flow of fuel passed therethrough from said meter and into the fueling hose;

(d) a fiber optic measuring device operably coupled to said meter, said measuring device being constructed and arranged to measure predetermined increments of fuel flowing through said meter during operation of the fuel dispenser;

(e) at least one set of fiber optic cables extending from said computer to said measuring device, said fiber optic light beam being passed through said at least one set of fiber optic cables, said measuring device being constructed and arranged to generate fiber optic signals passed on to said computer through said at least one set of fiber optic cables, said fiber optic signals being indicative of the quantity of fuel passed through said meter;

(f) said computer being coupled to said flow control valve and being constructed and arranged to control the operation of said flow control valve in response to the receipt of said fiber optic signals.

3. The fuel dispenser of claim 2, said fiber optic measuring device comprising a pulser constructed and arranged to interrupt the fiber optic light beam passed through said at least one set of fiber optic cables from said computer to generate said fiber optic signals.

4. The fuel dispenser of claim 3, said pulser comprising:

a housing;

an elongate shaft rotatably supported within said housing and being operably coupled to said meter for being rotated thereby;

a timing disc carried on and rotated with said shaft, said timing disc including a predetermined number of radial timing slots defined therein and extending therethrough; and at least one pair of opposed fiber optic cable end supports positioned on opposite sides of said timing disc and with respect to said timing slots, the cable ends of said at least one set of fiber optic cables being received within said end supports;

wherein said timing slots interrupt the beam of light passed between the opposed fiber optic cables of said at least one set of fiber optic cables held in said end supports to generate said fiber optic signals.

5. The fuel dispenser of claim 4, wherein each said fiber optic signal signals the computer that a predetermined quantity of fuel has passed through said meter to said computer.

6. A fuel dispenser, the fuel dispenser having a housing, a supply of fuel, a fuel dispensing system positioned within the housing and in fluid communication with the supply of fuel, and at least one fueling hose in fluid communication with the fuel dispensing system for dispensing the fuel therethrough, said fuel dispenser comprising:

(a) a housing;

(b) a computer positioned within said housing;

(c) a fuel discharge conduit extending from said housing;

(d) a discharge nozzle in fluid communication with said fuel discharge conduit for delivering fuel from said fuel discharge conduit;

(e) a fuel flow control valve positioned within the housing for delivering fuel to said fuel discharge conduit;

(f) a nozzle boot on said housing for receiving said nozzle when said nozzle is not in use;

(g) a fiber optic switch constructed and arranged to detect when said nozzle has been received by said boot; and (h) a set of fiber optic cables connected between said switch and said computer for transmitting a fiber optic light signal emitted by said switch when said nozzle is received in said boot, wherein said computer then causes said flow control valve to close for preventing the discharge of fuel from the fuel dispenser.

7. A fuel dispenser comprising:

(a) a housing;

(b) a fuel discharge conduit for said housing;

(c) a discharge nozzle externally of said housing for delivering fuel from said fuel discharge conduit;

(d) a barrier in said housing for dividing said housing into an upper chamber and a lower chamber;

(e) hydraulic elements is said lower chamber for delivering fuel to said fuel discharge conduit;

(f) electronic elements in said lower chamber for controlling the delivery of said fuel;

(g) said electronic elements generating signals for controlling the delivery of fuel by said hydraulic elements;

(h) a valve in said housing communicating with said fuel conduit;

(i) a nozzle boot on said housing for receiving said nozzle when said nozzle is not in use;

(j) a fiber optic switch for detecting when said nozzle has been received by said boot; and (k) a set of fiber optic cables connected between said switch and said computer for transmitting a light signal for indicating whether or not said nozzle is received in said boot and for causing the computer to dictate the closing of said valve.

8. A fuel dispenser comprising:

(a) a housing;

(b) a fuel discharge conduit for said housing;

(c) a boot on said housing;

(d) a discharge nozzle externally of said housing for delivering fuel from said fuel discharge conduit, said nozzle being removably stored in said boot when not in use;

(e) a valve in said housing communicating with said fuel conduit;

(f) electrical controls remote from said valve and connected to said valve; and (g) a fiber optic switch in said housing for detecting when said nozzle is stored in said boot, said switch being connected optically to said electrical controls for causing said valve to be closed when said nozzle is stored.

9. A fuel dispenser, comprising:

(a) a housing having hydraulic elements disposed therein for pumping fuel through said housing to a nozzle;

(b) a boot positioned on said housing said boot being sized and shaped to receive said nozzle; and (c) a horizontal shaft pivotally supporting said boot so that said boot may be pivoted about said shaft for access to the interior of said housing.

10. The fuel dispenser defined in claim 9 including control elements in said housing for controlling said hydraulic elements, a flapper for rotating said shaft when said nozzle is received in said boot, and a switch on said shaft for signaling rotation of said shaft to said control elements for causing said control elements to prevent delivery of fuel through said hydraulic elements to said nozzle.

* * * * *